US009010287B2

(12) United States Patent
Morreim

(10) Patent No.: US 9,010,287 B2
(45) Date of Patent: Apr. 21, 2015

(54) MULTI-FUEL ENGINE

(71) Applicant: Steven Morreim, Lehigh Acres, FL (US)

(72) Inventor: Steven Morreim, Lehigh Acres, FL (US)

( * ) Notice: Subject to any disclaimer, the term of this patent is extended or adjusted under 35 U.S.C. 154(b) by 0 days.

(21) Appl. No.: 14/212,013

(22) Filed: Mar. 14, 2014

(65) Prior Publication Data

US 2014/0265349 A1 Sep. 18, 2014

(51) Int. Cl.

| | |
|---|---|
| ***F02D 19/06*** | (2006.01) |
| ***F02B 75/28*** | (2006.01) |
| ***F02B 75/00*** | (2006.01) |
| ***F02B 63/04*** | (2006.01) |
| ***F02B 63/06*** | (2006.01) |

(52) U.S. Cl.
CPC ..... *F02B 75/002* (2013.01); *F02B 63/041* (2013.01); *F02B 63/06* (2013.01)

(58) Field of Classification Search
CPC ..... F02B 75/002; F02D 19/0692
USPC ..... 123/61 R, 61 V, 63, 53.6, 575
See application file for complete search history.

(56) References Cited

U.S. PATENT DOCUMENTS 2,171,783 A * 9/1939 Dennison ..... 123/195 R
2,392,052 A * 1/1946 Matheisel, Jr. ..... 123/50 R
6,854,429 B2 2/2005 Gelfand
7,703,435 B2 * 4/2010 Surnilla et al. ..... 123/304
8,499,728 B2 * 8/2013 Xie et al. ..... 123/53.6

FOREIGN PATENT DOCUMENTS

DE 3843207 A1 * 6/1990 ..... F01B 3/00

* cited by examiner

*Primary Examiner* — Lindsay Low
*Assistant Examiner* — Kevin Lathers
(74) *Attorney, Agent, or Firm* — Reinhart Boerner Van Deuren P.C.

(57) ABSTRACT

Internal combustion engines and methods of operating an internal combustion engine are provided. The engine may include double-ended pistons such that power strokes can be applied to drive the double-ended piston in both directions along the axis along which the piston reciprocates. In some engines, multiple pistons may be connected to a single piston shaft and arranged inline such that the motion thereof is in the same direction at all times along the piston axis of motion. In one engine, the double-ended piston divides a cavity of the engine block or cylinder wall into two separate compression chambers. Each compression chamber has its own fuel inlet. Each fuel inlet is coupled to a different fuel source such that one fuel may be combusted in one of the compression chambers and a different fuel is combusted in the other one of the compression chambers.

12 Claims, 17 Drawing Sheets

MULTI-FUEL ENGINE

CROSS-REFERENCE TO RELATED PATENT APPLICATIONS

This patent application claims the benefit of U.S. Provisional Patent Application No. 61/793,431, filed Mar. 15, 2013, the entire teachings and disclosure of which are incorporated herein by reference thereto.

FIELD OF THE INVENTION

This invention generally relates to internal combustion engines and more particularly to internal combustion engines that have a double-ended piston.

BACKGROUND OF THE INVENTION

Numerous fuels are used for internal combustion engines including gasoline, diesel, natural gas, liquid natural gas (LNG), liquid petroleum (LP), Methane, ethanol, hydrogen, etc. Unfortunately, different fuels have different power output, fuel efficiency, cost, emissions, and regional availability. As such, it may be desirable to run an engine on LNG but only diesel or gasoline is available in a particular area. As such, it may not be able to get the benefits of running on LNG in that particular area. Further, if one fuel has a much greater power output but a poorer emissions than another fuel, it is typically necessary to compromise on one of the two categories in designing the engine when using current one-side engines. This may be very problematic for over-the-road heavy trucks that have very long trips where high power is only needed for a small portion of the trip and it is desirable to remain within ever increasing emissions standards.

Further, typical one-sided pistons only have a power stroke in one direction and rely on angular momentum and kinetic energy of the engine to drive the piston when power is not being supplied to the piston during an ignition portion of the engine cycle. Due to this, a period of time when additional power could be added to the system is being wasted.

The present invention provides improvements over the current state of the art for internal combustion engines.

BRIEF SUMMARY OF THE INVENTION

Embodiments of the invention provide a new and improved dual power stroke internal combustion engine that utilizes a double-ended piston. Further, embodiments of the invention provide a new and improved dual fuel internal combustion engine to provide improved tailoring of the output of the engine in view of available fuels, fuel emissions, power requirements, fuel costs, etc. Further embodiments of the invention provide a new and improved internal combustion engine that provides for multiple-in-line double-ended pistons.

In a particular embodiment, an engine including a cylinder wall, a pair of cylinder head portions, a double ended piston, a piston shaft, a crankshaft, a connecting rod, and first and second fuel injectors is provided. The cylinder wall defines a cavity. The pair of cylinder head portions is attached to the cylinder wall and close opposite ends of the cavity. The double-ended piston has opposed piston faces that face axially away from one another. The double-ended piston is positioned within the cavity and separates the cavity into separate first and second compression chambers. The piston shaft extends through at least one of the cylinder head portions and operably connects to the double-ended piston. The piston shaft moves in reciprocating linear motion with the double-ended piston. The connecting rod operably couples the piston shaft to the crankshaft. The first fuel injector is operably coupled to a first source of fuel and is positioned to inject the first fuel into the first compression chamber. The second fuel injector is operably coupled to a second source of fuel that is different than the first source of fuel and is positioned to inject the second fuel into the second compression chamber.

In a more particular embodiment, the engine further includes a controller configured to control operation in a dual power stroke mode where combustion occurs in both the first and second compression chambers.

In a more particular embodiment, the controller is also configured to control operation in a single power stroke mode where combustion occurs in only either the first or second compression chamber. The controller may be configured to switch between the dual power stroke mode and the single power stroke mode.

In a more particular embodiment, the controller is also configured to switch between the dual power stroke mode and the single power stroke mode depending on the loading on the engine.

In another embodiment, the engine further includes a second cylinder wall, a second pair of cylinder head portions, a second double-ended piston, and third and fourth fuel injectors. The second cylinder wall defines a second cavity. The second pair of cylinder head portions are attached to the second cylinder wall and close opposite ends of the second cavity. The second double-ended piston has opposed piston faces that face axially away from one another. The second double-ended piston is positioned within the second cavity and separates the second cavity into separate third and fourth compression chambers. The second double-ended piston is operable connected to the piston shaft such that the piston shaft, first double-ended piston, and second double-ended piston move in coordinated reciprocating linear motion. The third fuel injector is operably coupled to the first source of fuel positioned to inject the first fuel into the third compression chamber. The fourth fuel injector is operably coupled to the second source of fuel positioned to inject the second fuel into the fourth compression chamber. While two double-ended pistons are connected in series in this embodiment, alternative embodiments could any number of pistons connected in series.

In another embodiment, the compression ratio of the first compression chamber is different than the compression ratio of the second compression chamber.

In one embodiment, the engine further includes controlled device that operates on linear reciprocating motion and is connected to the piston shaft on an opposite axial side of the double-ended piston as the connecting rod. In particular embodiments, the controlled device is a fluid pump or a generator. In an embodiment where the controlled device is a fluid pump, the fluid pump is an air pump and an outlet of the air pump is fluidly coupled to an intake port of at least one of the first and second combustion chambers.

In another embodiment, an engine including an engine including a cylinder wall, a pair of cylinder head portions, a double ended piston, first and second fuel injectors, a second cylinder wall, a second pair of cylinder head portions, a second double-ended piston, third and fourth fuel injectors, a piston shaft, a crankshaft, and a connecting rod is provided. The first cylinder wall defines a first cavity. The first pair of cylinder head portions are attached to the first cylinder wall and close opposite ends of the first cavity. The first double-ended piston has opposed piston faces that face axially away from one another. The first double-ended piston is positioned within the first cavity and separates the first cavity into separate first and second compression chambers. The first fuel injector is positioned to inject fuel into the first compression chamber. The second fuel injector is positioned to inject fuel into the second compression chamber. The second cylinder wall defines a second cavity. The second pair of cylinder head portions is attached to the second cylinder wall and closing opposite ends of the second cavity. The second double-ended piston has opposed piston faces that face axially away from one another. The second double-ended piston is positioned within the second cavity and separates the second cavity into separate third and fourth compression chambers. The third fuel injector is positioned to inject fuel into the third compression chamber. The fourth fuel injector is positioned to inject fuel into the fourth compression chamber. The piston shaft extends axially through the first pair of cylinder head portions and is operably connected to the first double-ended piston. The piston shaft extends through at least one of the second pair of cylinder head portions and is operably connected to the second double-ended piston. The piston shaft moves in reciprocating linear motion with the first and second double-ended pistons. A connecting rod operably couples the piston shaft to the crankshaft. While two double-ended pistons are connected in series in this embodiment, alternative embodiments could any number of pistons connected in series.

In another engine, a cylinder wall, a pair of cylinder head portions, a double-ended piston, a piston shaft, a crankshaft, a connecting rod, a first fuel injector and a second fuel injector is provided. The cylinder wall defines a cavity. The pair of cylinder head portions are attached to the cylinder wall and close opposite ends of the cavity. The double-ended piston has opposed piston faces that face axially away from one another. The double-ended piston is positioned within the cavity and separates the cavity into separate first and second compression chambers. The piston shaft extends through at least one of the cylinder head portions and is operably connected to the double-ended piston. The piston shaft moves in reciprocating linear motion with the double-ended piston. The connecting rod operably couples the piston shaft to the crankshaft. The first fuel injector is positioned to inject fuel into the first compression chamber. The second fuel injector is positioned to inject fuel into the second compression chamber.

A method of operating an engine is also provided. The engine could be any of the engines identified above. The method includes injecting the first fuel into the first compression chamber for combustion therein; and injecting the second fuel into the second compression chamber for combustion therein.

In a more particular method, the steps of injecting the first and second fuels alternate repeatedly such that the double-ended piston is repeatedly subject to a power stroke in both directions and applied to both piston faces.

In a more particular method, the step of injecting the first fuel is repeated for at least 10 times prior to the step injecting the second fuel. This embodiment is used where the engine will run for an extended period of time using only one of the sides of the double-ended piston(s) and then shift to using the either the other side or using both sides. In an even more particular method, the method includes switching from injecting the first fuel to the second fuel occurs at a predetermined change in loading on the engine.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
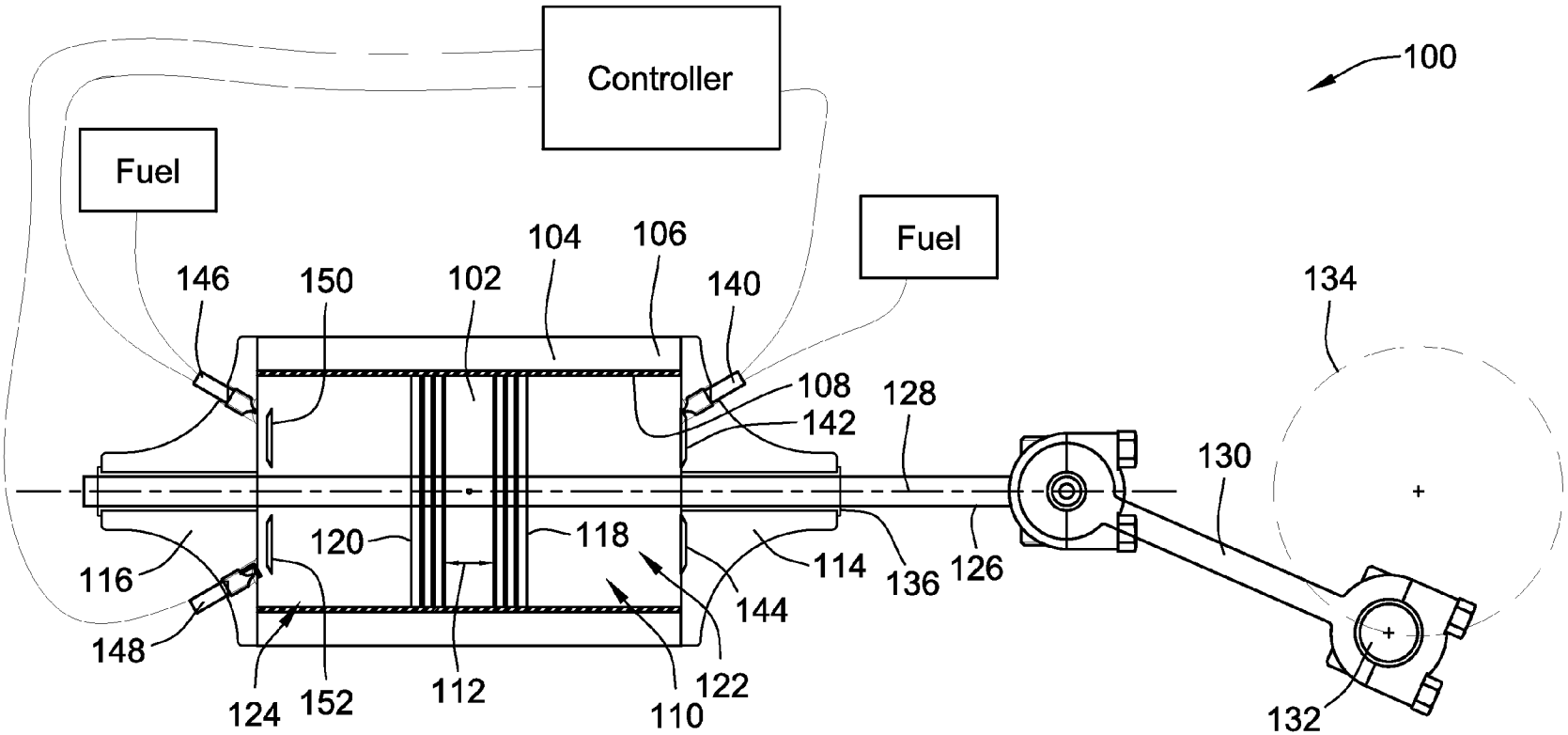
FIG. 1 is a simplified schematic illustration of an embodiment of engine.

FIG. 1 is a simplified illustration of a portion of an internal combustion engine 100 according to an embodiment of the present invention. Internal combustion engine 100 is a dual power stroke internal combustion engine that can provide a power stroke in both directions. As such, the internal combustion engine 100 includes a double-ended piston 102.

The double ended piston 102 is positioned within an engine block 104 that defines cylinder wall 106 which in the illustrated embodiment has a cylinder liner 108, e.g. a cylinder sleeve. The cylinder liner 108 defines a cavity 110 in which the double-ended piston 102 can translate axially as indicated by arrow 112. The cavity 110 is generally closed at opposite ends by first and second cylinder heads 114, 116. The double-ended piston 102 includes opposed piston faces 118, 120 that axially face away from one another and face a corresponding one of the cylinder heads 114, 116. The double-ended piston 102 divides the cavity into two separate compression chambers 122, 124.

The double-ended piston 102 is connected to a piston shaft 126 that translates axially with the double-ended piston 102 along a travel axis 128 of the double-ended piston 102. The piston shaft 126 extends through at least one of the cylinder heads 114, 116. The piston shaft 126 is operably connected to a connecting rod 130 at a free end. The connection between the piston shaft 126 and the connecting rod 130 is configured to allow the connecting rod 130 to rotate relative to the piston shaft 126. An opposite free end of the connecting rod 130 is operably connected to a crank shaft 132. The connection between the connecting rod 130 and the crank shaft 132 is configured to allow the connecting rod to rotate relative to the crank shaft 132. The pivoting connections of the connecting rod 130 allows for the linear motion of the piston shaft 126 to be transferred to crank shaft 132. The rotational path of the crank shaft 132 is illustrated by dashed circle 134.

A bushing 136 provides a seal between the outer surface of the piston shaft 126 and the bore of the cylinder head 114 through which the piston shaft 126 extends.

The embodiment of FIG. 1 is configured to be a gas-over-diesel dual power stroke engine. As such, the diesel fuel is combusted in the first compression chamber 122 and gasoline is combusted in the second compression chamber 124. Because diesel fuel is typically compressed at a higher ratio than gasoline, the first compression chamber 122 is considered a high compression compression chamber and the second compression chamber 124 is considered a low compression compression chamber.

Because the first compression chamber 122 is configured for diesel fuel combustion, the first cylinder head 114 has a diesel fuel injector 140 for injection of diesel fuel. While not shown, a glow plug could be provided and in communication with the first compression chamber 122 if desired. A diesel intake valve 142 is provided for regulating the intake gas into the first compression chamber 122. A diesel exhaust valve 144 is provided for regulating the exhaust gases that are generated and then exhausted from the first compression chamber 122. While only single diesel intake and exhaust valves 142, 144 are illustrated, multiple of each valve may be provided in alternative embodiments. These valves 142, 144 operably open and close corresponding ports extending through the first cylinder head 114 that are operably coupled to corresponding intake and exhaust systems of the internal combustion engine 100. The intake and exhaust systems may include turbo charger or super charger systems.

Because the second compression chamber 124 is configured for gasoline combustion, the second cylinder head 116 has a gasoline fuel injector 146 for injection of gasoline. A sparkplug 148 is in fluid communication with the second compression chamber 124 for ignition of atomized gasoline. A gasoline intake valve 150 is provided for regulating the intake gas into the second compression chamber 124. A gas exhaust valve 152 is provided for regulating the exhaust gases that are generated and then exhausted from the second compression chamber 124. While only single gasoline intake and exhaust valves 150, 152 are illustrated, multiple of each valve may be provided in alternative embodiments. These valves 150, 152 operably open and close corresponding ports extending through the second cylinder head 116 that are operably coupled to corresponding intake and exhaust systems of the internal combustion engine 100. Typically, both compression chambers 114, 116 will use the same intake and exhaust systems.

All of the valves 142, 144, 150, 152 would be operably controlled by appropriate valve actuator devices such as electronic actuators or mechanical actuators or a combination of electronic and mechanical actuators.

While being described as a gas-over-diesel internal combustion engine, other combinations of fuel are contemplated. Further, a same type of fuel system is contemplated, such as gas-over-gas or diesel-over-diesel, for example.

With reference to FIGS. 3-10, one operational cycle of an embodiment of the internal combustion engine 100 will be described.

Figure 2:
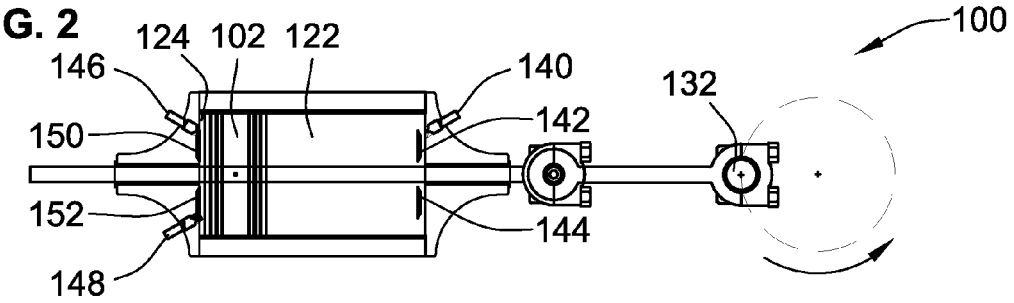
FIGS. 2-10 illustrate the progression of the engine in FIG. 1 during one complete combustion cycle.

In FIG. 2, the double-ended piston 102 is at a top of the stroke with maximum compression of the second compression chamber 124 (i.e. the gas side). The first compression chamber 122 (i.e. the diesel side) is at the bottom of the stroke. The gasoline intake and exhaust valves 150, 152 are closed. The diesel intake and exhaust valves 142, 144 are open in preparation for exhausting previously compressed diesel fuel within the first compression chamber 122. Further, the piston 102 is beginning to change directions and begin to move toward the crankshaft 132 under the gasoline power stroke. The crankshaft 132 is at the top of the gas end stroke. The sparkplug 148 will have fired at, typically, 3 to 11 degrees prior to top dead center depending on the RPM of the engine. Gasoline will have typically been previously injected into the second compression chamber 124. The diesel fuel injector 140 will be inactive.

Figure 3:
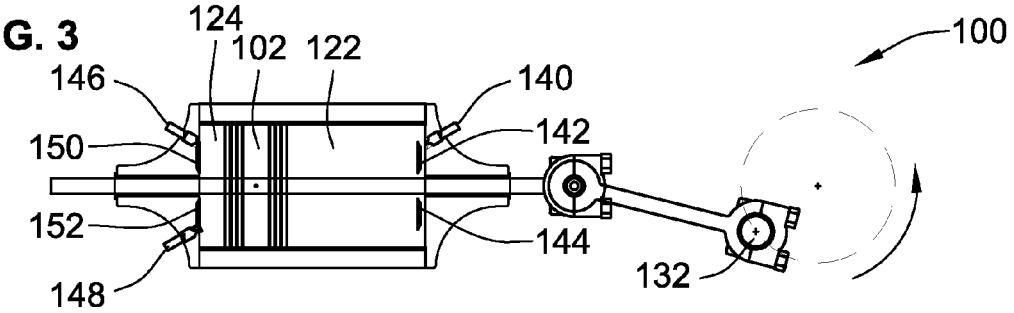

In FIG. 3, the double-ended piston 102 will be moving toward the crankshaft 132 (i.e. the right of the page) under the gasoline power stroke. The gasoline intake and exhaust valves 150, 152 remain closed. The diesel intake and exhaust valves 142, 144 remain open to exhaust the diesel exhaust and receive fresh intake gases (i.e. air). The crankshaft 132 is at the beginning of the gas power stroke and rotating in the counterclockwise direction. The sparkplug 148 is inactive. The gasoline fuel injector 146 is inactive. The diesel fuel injector 140 is inactive.

Figure 4:
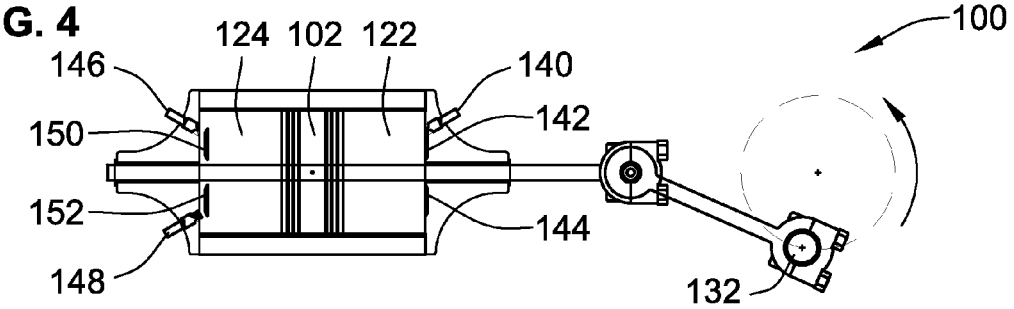

In FIG. 4, the double-ended piston 102 is continuing to move toward the crankshaft 132 under the gas power stroke and is at the middle of the piston stroke. The gasoline intake and exhaust valves 150, 152 open. The diesel intake and exhaust valves 142, 144 are closed and the first compression chamber 122 begins compression. The sparkplug 148 is inactive. The gasoline fuel injector 146 is inactive. The diesel fuel injector 140 may be activated after the diesel intake and exhaust valves 142, 144 are closed.

Figure 5:
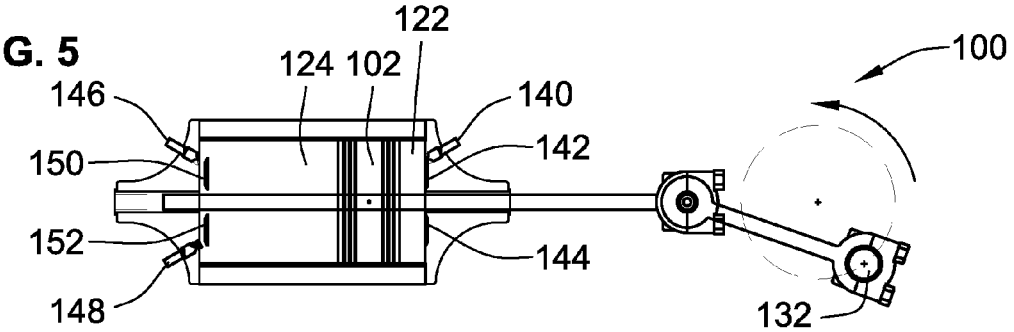

FIG. 5 is similar to FIG. 4, except the piston 102 has moved further toward crank shaft 132. The first compression chamber 122 (diesel side) is at mid-compression. The diesel intake and exhaust valves 142, 144 remain closed. The gasoline intake and exhaust valves 150, 152 remain open. The sparkplug 148, gasoline fuel injector 146 and diesel fuel injector 140 are inactive.

Figure 6:
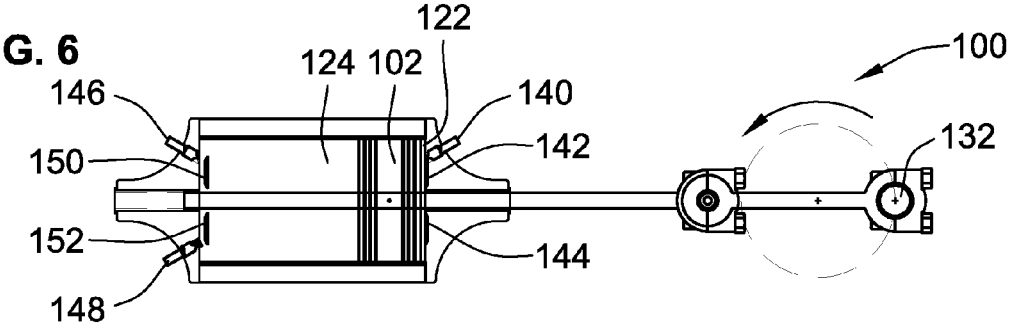

In FIG. 6, the piston has reached the bottom of the gas-side stroke and at the diesel side is at top dead center. The diesel side (i.e. first compression chamber 122) is at maximum compression and combustion occurs beginning the diesel power stroke. The gasoline intake and exhaust valves 150, 152 remain open and the diesel intake and exhaust valves 142, 144 remain closed. The piston 102 will begin to change directions under the diesel power stroke. The sparkplug 148, gasoline fuel injector 146, and diesel fuel injector 140 are all inactive.

Figure 7:
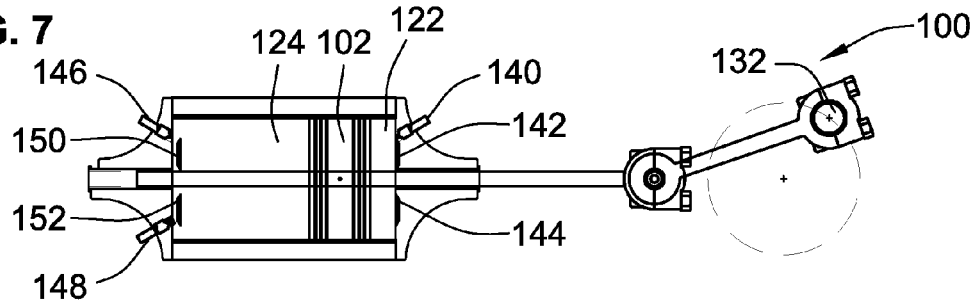

In FIG. 7, the piston 102 begins compression of the second compression chamber 124 (gas side) and pushing the gasoline exhaust gases out of the second compression chamber 124. The piston 102 has changed directions and is moving away from crankshaft 132 as the diesel fuel combustion causes expansion of the gases within the first compression chamber 122. The diesel intake and exhaust valves 142, 144 remain closed as the diesel side is in the middle of the diesel side power stroke. The gasoline intake and exhaust valves 150, 152 begin to close in preparation for compression within the second compression chamber 124. The sparkplug 148, gasoline fuel injector 146 and diesel fuel injector 140 are all inactive.

Figure 8:
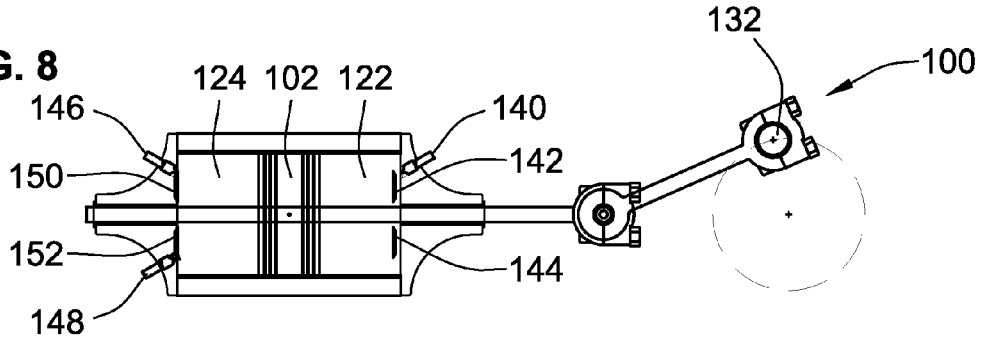

In FIG. 8, the double-ended piston 102 is mid-stroke of the diesel power stroke and midway through the gasoline compression stroke. The gasoline intake and exhaust valves 150, 152 are closed as the pressure within the second compression chamber 124 begins to increase. The diesel intake and exhaust valves 142, 144 begin to open. The sparkplug 148 is inactive, the gasoline fuel injector 146 will be activated at the desired time, and the diesel fuel injector 140 will be inactive.

Figure 9:
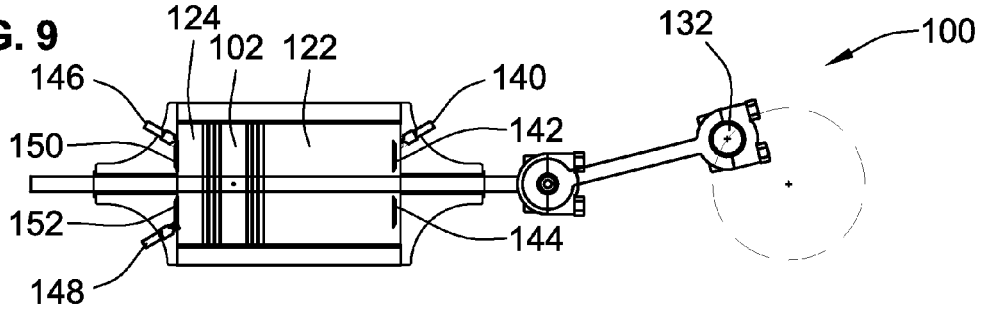

In FIG. 9, the double-ended piston will be beginning high compression within the second compression chamber 124 on the gas side. The gasoline intake and exhaust valves 150, 152 will remain closed. The diesel intake and exhaust valves 142, 144 will be open as fresh air enters the first compression chamber 122 and exhaust exits the first compression chamber 122. The sparkplug 148 will fire. Typically, the sparkplug 148 will fire between 3 and 11 degrees prior to top dead center depending on the RPM of the engine 100. The gasoline fuel injector 146 and diesel fuel injector 140 are inactive.

Figure 10:
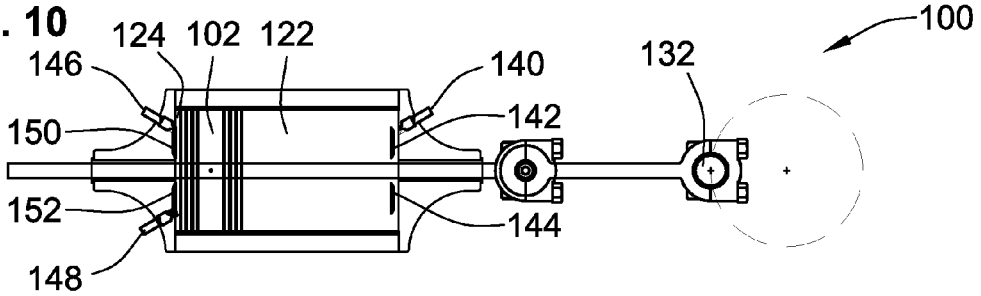

FIG. 10 is identical to FIG. 2 and the cycle repeats.

Typically, in this type of engine 100, where there are two different types of fuels being used, the compression ratio will be different for the first compression chamber 122 as compared to the second compression chamber 124. For instance, the compression ratio for the first compression chamber 122 may be between 14 to 1 and 18 to 1 because that side is configured for diesel. However, the compression ratio for the second compression chamber 124 may be between 6 to 1 and 12 to 1 because that side is configured for gasoline. However, other configurations are possible depending on the different types of fuels that are being used.

Figure 11:
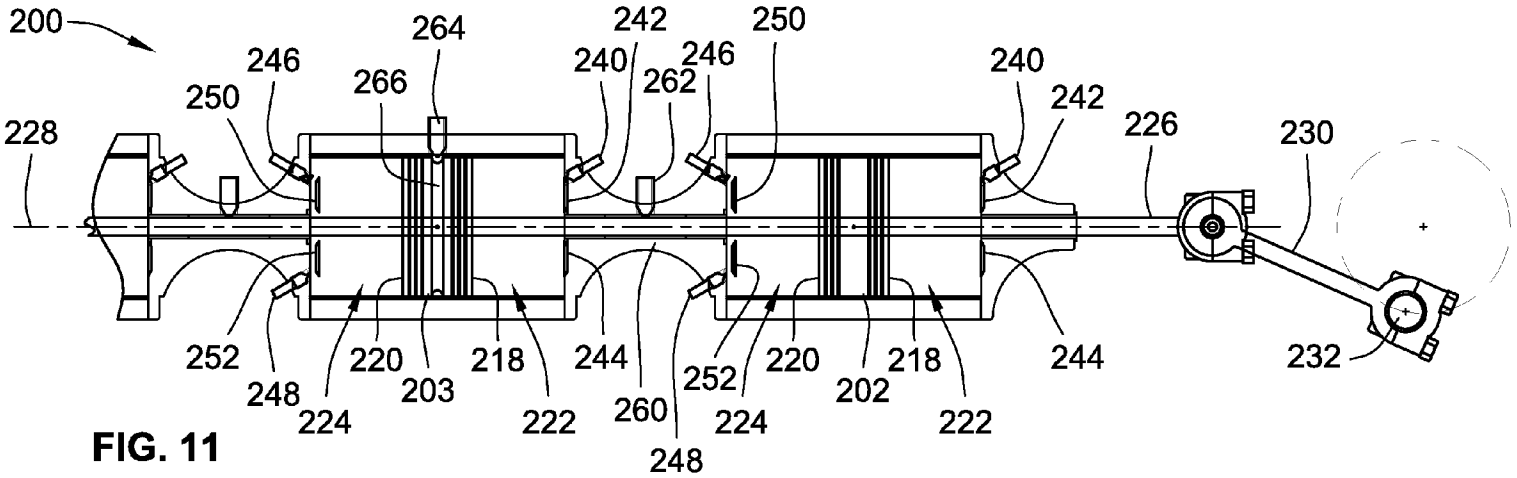
FIG. 11 is a simplified schematic illustration of an alternative embodiment of an engine.

FIG. 11 is an alternative embodiment of a dual power stroke internal combustion engine 200. This dual power stroke internal combustion engine is similar to the prior embodiment of FIG. 1 in that it is a gas-over-diesel engine. However, this engine 200 includes a plurality of inline double-ended pistons 202, 203. Each double-ended piston and corresponding structure, such as the cylinder wall, valves, injectors, sparkplugs, glow plugs, oilers, etc. may be considered a piston unit. While only two double-ended pistons 202, 203 are illustrated inline, it is contemplated that more than two pistons 202, 203 could be incorporated and that any number of double-ended pistons could be implemented The two double-ended pistons 202, 203 are operably connected to a single piston shaft 226, which may be a single component or a plurality of components coupled together. The single piston shaft 226 is coupled to crankshaft 232 by a connecting rod 230 in similar fashion as the prior embodiment. In this embodiment, all of the pistons 202, 203 coupled to piston shaft 226 move in the same direction along and co-axial with common travel axis 228.

In this embodiment, each of double-ended pistons 202, 203 have a first piston face 218 that cooperates with a diesel compression chamber 222 and a second piston face 220 that cooperates with a gasoline compression chamber 224. The combustion cycle for each of the double-ended pistons 202, 203 will be similar to that as described with reference to FIGS. 3-10 for the embodiment of FIG. 1. Each piston 202, 203 will have a corresponding set of intake and exhaust valves 242, 244, 250, 252 for each of the compression chambers 222, 224 as well as the corresponding diesel and gasoline fuel injectors 240, 246, as well as a corresponding sparkplug 248.

In this embodiment, a complex intermediate cylinder head 260 is positioned between and forms apart of adjacent cavities for adjacent double-ended pistons 202, 203. More particularly, cylinder head 260 closes the gasoline end of the cavity in which the first double-ended piston 202 is located and the diesel end of the cavity in which the second double-ended piston 203 is located. The single piston shaft 226 extends entirely axially through the single complex cylinder head 260.

This embodiment illustrates that option oilers may be included. For instance, cylinder head oiler 262 lubricates the piston shaft 226 as it reciprocates back and forth within the bore extending through cylinder head 260. A piston oiler 264 communicates with an oiler ring 266 and the outer cylindrical surface of double-ended piston 203 to lubricate the piston 203 within its corresponding cavity.

Figure 12:
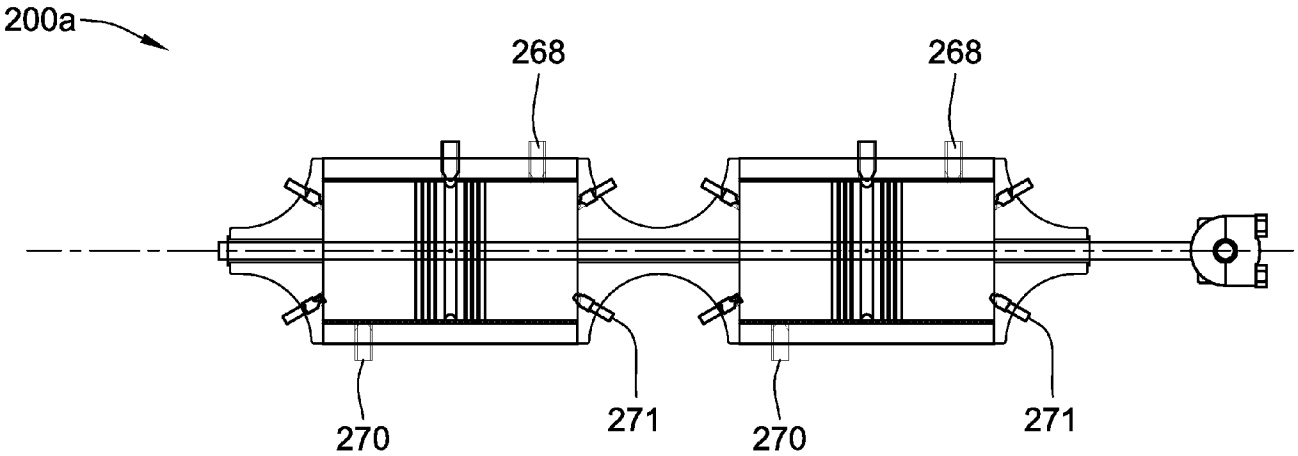
FIG. 12 is a simplified schematic illustration of an alternative embodiment of the engine of FIG. 11.

FIG. 12 illustrates an internal combustion engine 200A similar to that of FIG. 11. This embodiment is again a gas-over-diesel internal combustion engine and also an inline engine where multiple double-ended pistons are connected to the same piston shaft. This embodiment illustrates further lubrication by including oilers 268, 269 that repositioned closer to the ends of the piston stroke. This embodiment also includes optional preheaters 271 at the diesel side of the system.

Figure 13:
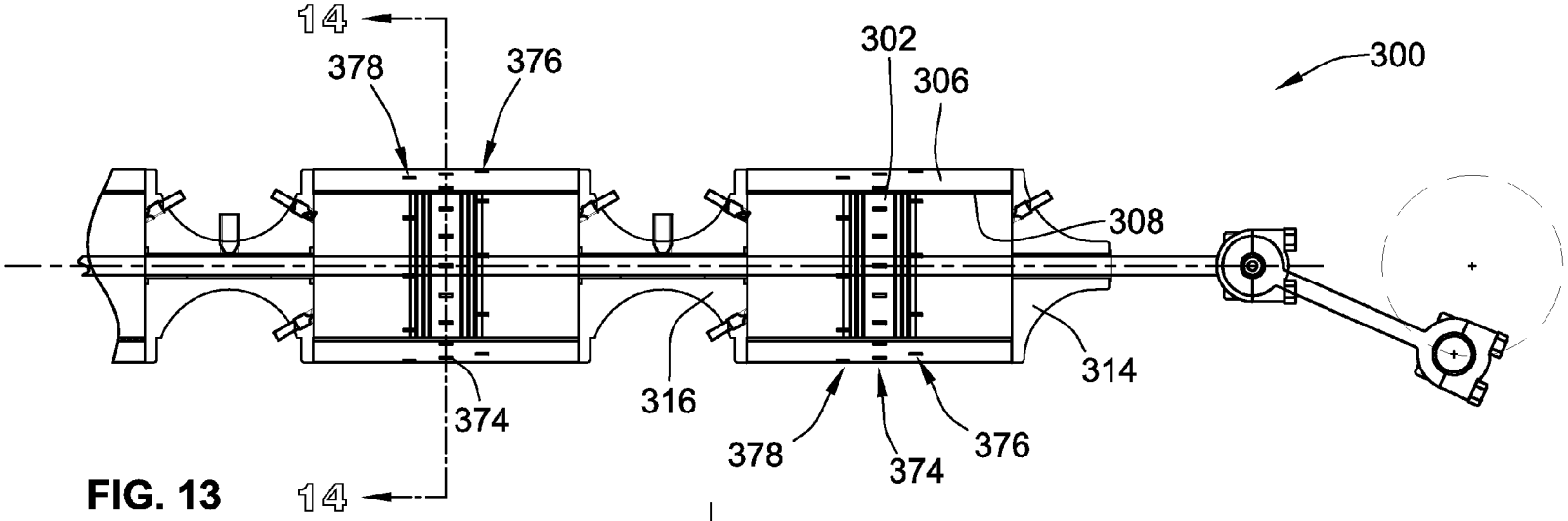
FIGS. 13 and 14 are simplified schematic illustrations of an alternative embodiment of an engine.
Figure 14:
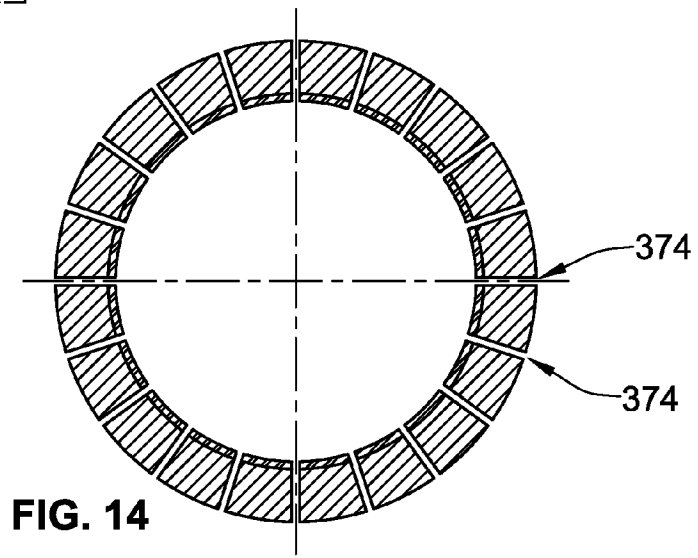

FIGS. 13 and 14 illustrate a further embodiment of a gas-over-diesel internal combustion engine 300 according to an embodiment of the invention. This embodiment is similar to the embodiments of FIGS. 11 and 12 in that it is an inline internal combustion engine. However, rather than including the various valving of the prior embodiments illustrated in FIGS. 1-12, this embodiment utilizes fixed ports or vanes for allowing entry of intake gases and removal of exhaust gases.

Because the individual piston arrangements are substantially identical, only double ended piston 302 and the cooperating components will be described. The cylinder wall 306 and sleeve 308 include first set of exhaust vanes 374 that are angularly spaced about the central axis of the system. In the illustrated embodiment, the exhaust vanes 374 are centered axially between the opposed cylinder heads 314, 316.

The cylinder wall 306 and sleeve 308 also includes first and second sets of intake vanes 376, 378 that are angularly spaced about the central axis of the system. Typically, the intake vanes 376, 378 are coupled to a pressurized air manifold (not shown). The position of the double-ended piston determines which of the vanes 374, 376, 378 are exposed to either allow the inflow of fresh intake gas or evacuation of exhaust gases. Depending on the arrangement of the engine 300, the first and second sets of intake vanes 376, 378 may or may not be the same axial distance from the exhaust vanes 374.

Figure 15:
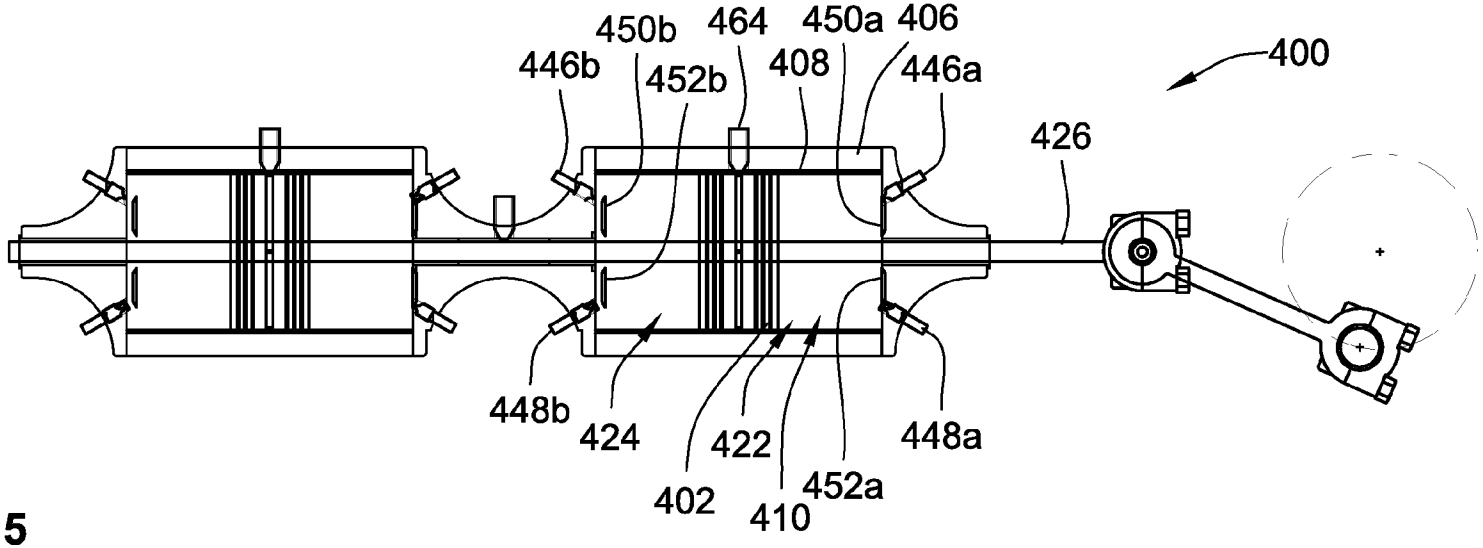
FIG. 15 is a simplified schematic illustration of an alternative embodiment of an engine.

FIG. 15 illustrates further embodiment of a dual power stroke internal combustion engine 400 according to an embodiment of the present invention. This embodiment utilizes a gas-over-gas internal combustion engine. This embodiment is also an inline internal combustion engine. However, the gas-over-gas configuration could be used in standard non-inline style engines such as a V-8 or straight 4 or straight 6 style engine. As used herein in "inline" shall refer to when all of the pistons that are inline translate coaxial with one another.

The engine 400 includes a cylinder wall 406 and sleeve 408 that defines cavity 410 in which the double-ended piston 402 is situated. An oiler 464 is aligned substantially axially centered between the ends of the cavity 410 for lubricating the double-ended piston 402.

The piston 402 is coupled to single piston shaft 426 along with piston 403.

The piston 402 divides cavity 410 into first and second compression chambers 422, 424. These compression chambers 422, 424 are substantially identically configured and have similar spark plugs 448A, 448B, gasoline fuel injectors 446A, 446B and gasoline intake and exhaust valves 450A, 450B, 452A, 452B. The fuel injectors 446A, 446B could be ported to a common fuel supply and the intake and exhaust valves 450A, 450B, 452A, 452B could similarly be ported to common intake and exhaust systems.

Figure 16:
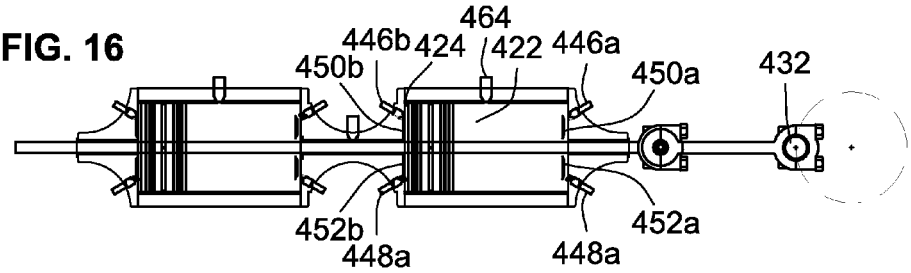
FIGS. 16-24 illustrate the progression of the engine in FIG. 15 during one complete combustion cycle.

Operation of the engine 400 will be described with reference to FIGS. 16-24. In FIG. 16, the double-ended piston 402 is at its top dead center position for compression chamber 424, which is the maximum compression position. Intake and exhaust valves 450B, 452B are closed while intake and exhaust valves 450A, 452A are open. Sparkplug 448B is active to initiate the power stroke for the left compression chamber 424. Fuel injectors 448A, 448B and sparkplug 446A are inactive. Piston oiler 464 is inactive.

Figure 17:
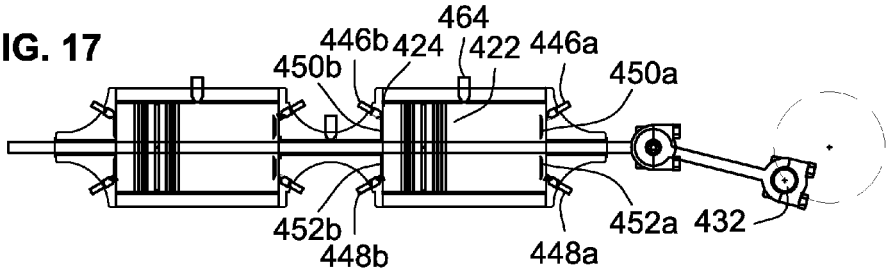

In FIG. 17, the double-ended piston 402 is moving to the right and toward crankshaft 432 under power stroke due to combustion within second compression chamber 424. The left side intake and exhaust valves 450B, 452B are closed. The right side intake and exhaust valves 450A, 452A are open and continue to exhaust combustion gases and receive fresh air. Sparkplugs 448A, 448B, fuel injectors 446A, 446B, and piston oiler 464 are all inactive.

Figure 18:
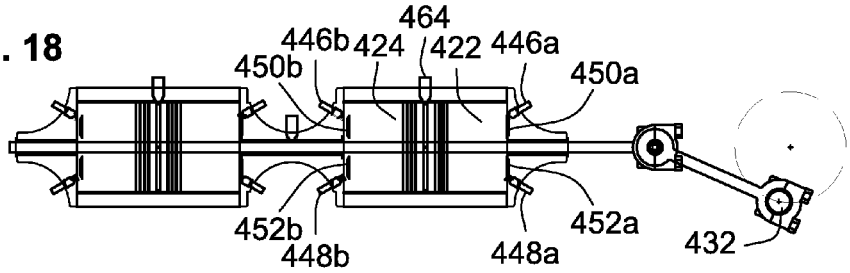

In FIG. 18, the piston 402 is at the midpoint of its stroke. The intake and exhaust valves 450B, 452B open on the left side while intake and exhaust valves 450A, 452A close on the right side to begin compression within compression chamber 422, which is at low compression. Sparkplugs 448A, 448B are inactive. Gasoline fuel injector 446B is inactive. Gasoline fuel injector 446A is active after intake and exhaust valves 450A, 452A are closed. Piston oiler 464 is active.

Figure 19:
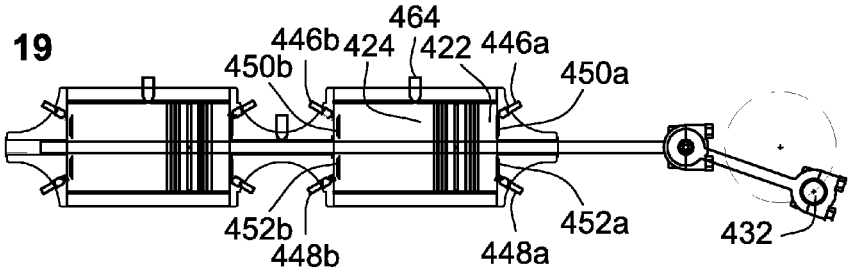

In FIG. 19, the piston 402 is still moving to the right. Compression chamber 422 is increasing in compression. The intake and exhaust valves 450A, 452A are closed as compression increases. Intake and exhaust valves 450B, 452B are open. Sparkplug 448B is inactive. Sparkplug 448A is active at approximately between 3 to 11 degrees prior to top dead center. Fuel injector 446B is inactive. Fuel injector 446A operates at normal point for achieving proper gas/air mixture. Piston oiler 464 is inactive.

Figure 20:
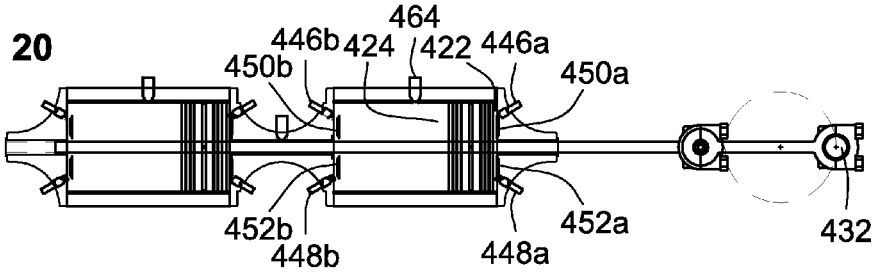

In FIG. 20, the piston 402 is at bottom dead center for left side compression chamber 424 and top dead center for right side compression chamber 422. As such, compression chamber 424 is at maximum compression. The intake and exhaust valves 450B, 452B are open. Intake and exhaust valves 450A, 452A remain closed. Fuel injectors 446A, 446B are inactive. Sparkplugs 448A, 448B are inactive. The piston oiler 464 is inactive.

Figure 21:
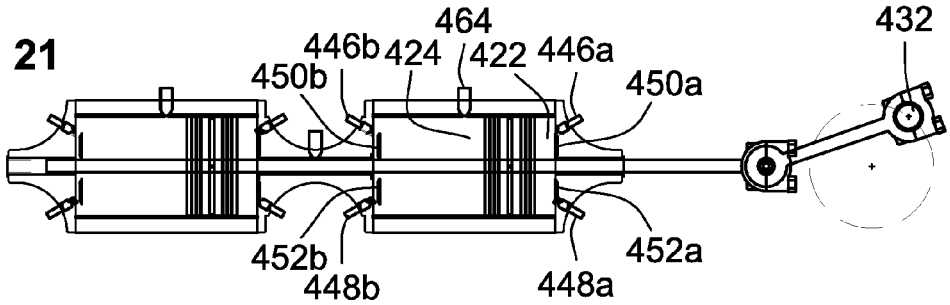

In FIG. 21, the left side compression chamber 424 is finishing exhausting and intaking of fresh air. The piston 402 is moving to the left side and has changed directions. The right side intake and exhaust valves 450A, 452A are still closed. The left side intake and exhaust valves 450B, 452B are beginning to close. The fuel injectors 446A, 446B are inactive. The sparkplugs 448A, 448B are inactive. The piston oiler 464 is inactive. The right side compression chamber is in the middle of a power stroke.

Figure 22:
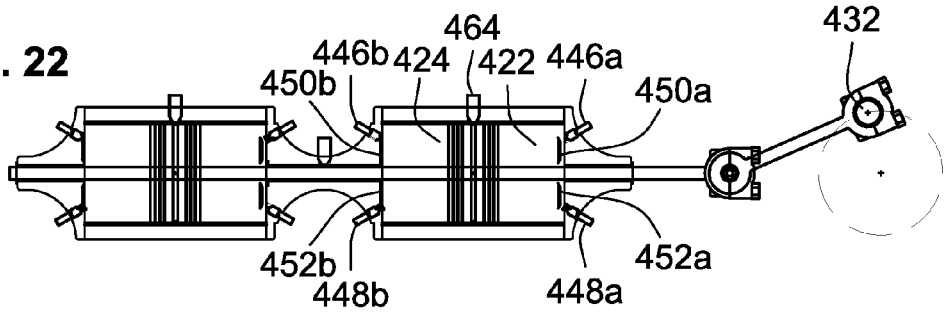

In FIG. 22, the piston 402 is in the midpoint of its stroke. Intake and exhaust valves 450B, 452B, are closed and compression chamber 424 is at starting compression. Intake and exhaust valves 450A, 452A are open. Sparkplugs 448A, 448B are inactive. Injector 446A is inactive. Fuel injector 446B can be activated when optimal for desired fuel-air mixture. The piston oiler 464 is inactive.

Figure 23:
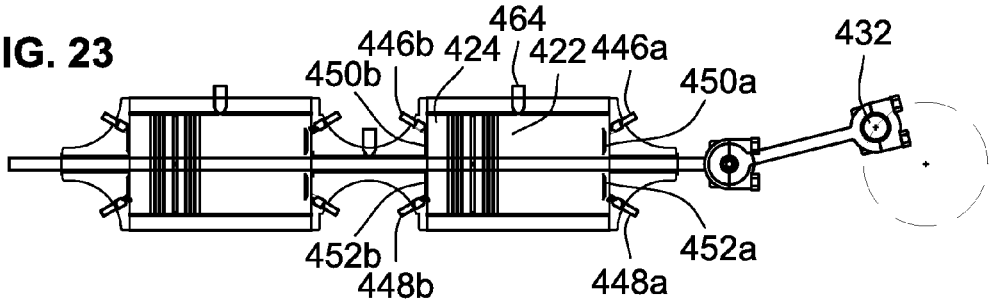

In FIG. 23, the piston 402 is moving toward high compression within compression chamber 424. The intake and exhaust valves 450B, 452B are closed on the left side and intake and exhaust valves 450A, 452A are open on the right side. Sparkplug 448B will fire at 3 to 11 degrees before top dead center depending on RPM of engine. Sparkplug 448A is inactive. Again, the left fuel injector 446B may be active. The right fuel injector 446A is inactive along with the piston oiler.

Figure 24:
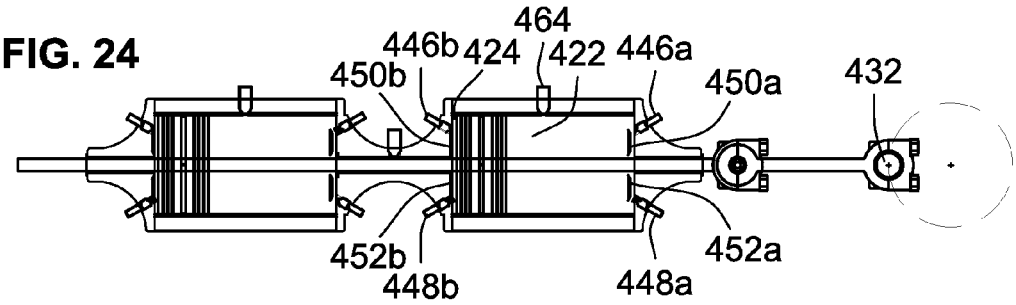

FIG. 24 is identical to FIG. 16 and the cycle repeats.

Figure 25:
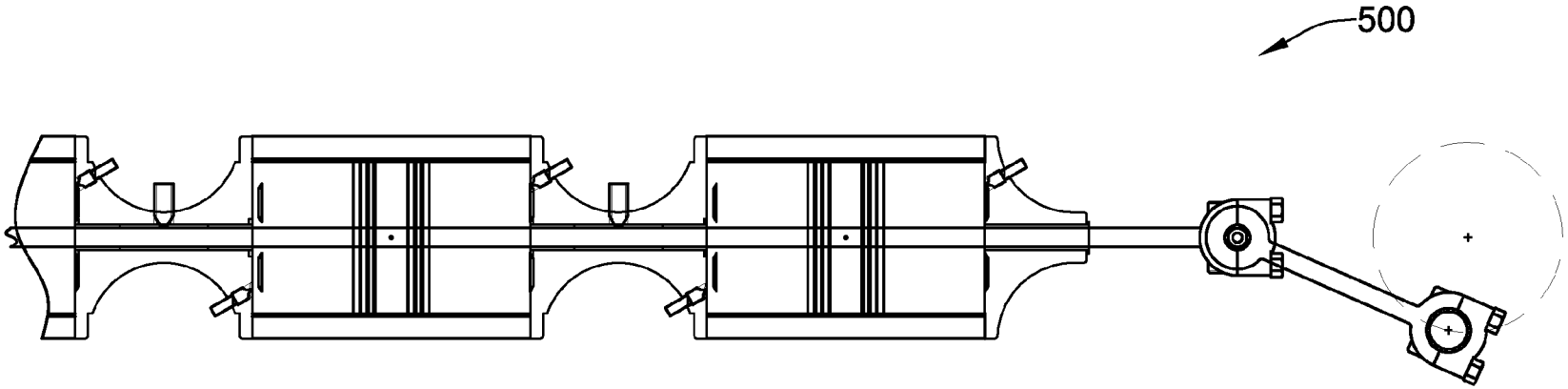
FIG. 25 is a simplified schematic illustration of an alternative embodiment of an engine.
Figure 26:
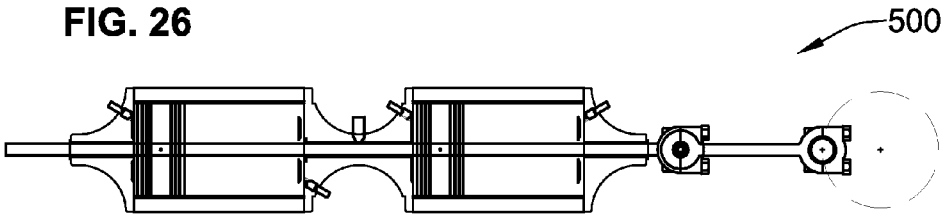
FIGS. 26-34 illustrate the progression of the engine in FIG. 25 during one complete combustion cycle.
Figure 27:
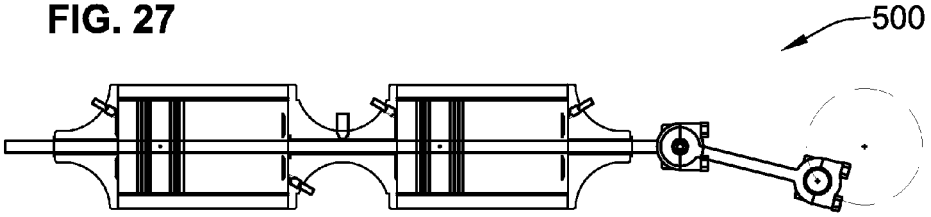
Figure 28:
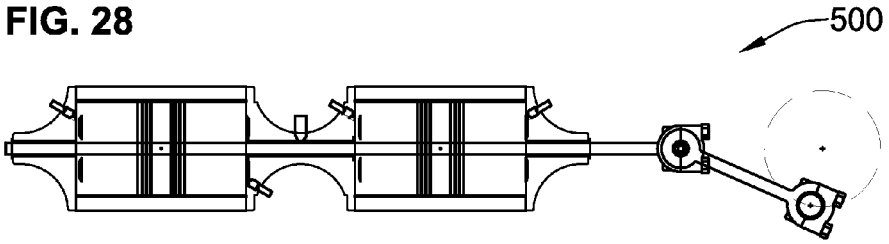
Figure 29:
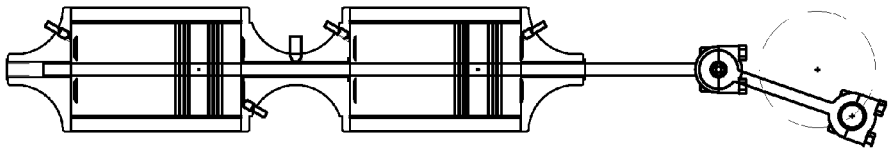
Figure 30:
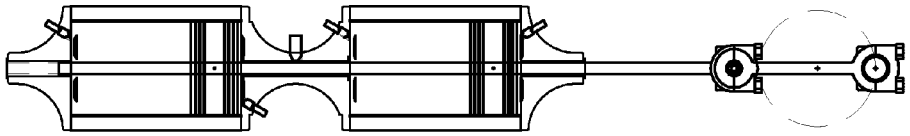
Figure 31:
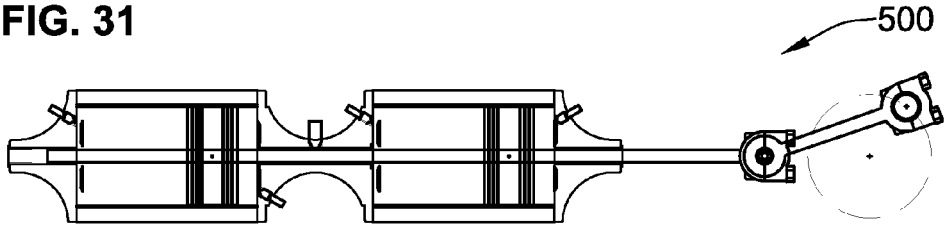
Figure 32:
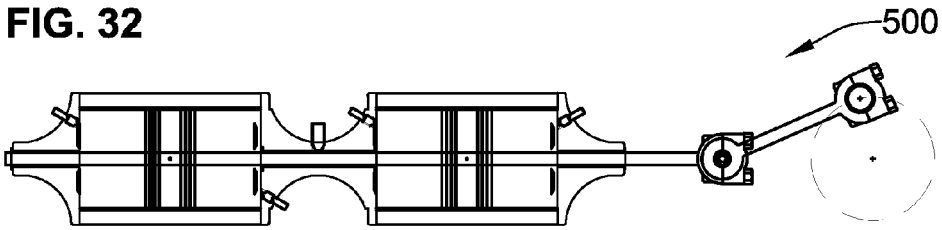
Figure 33:
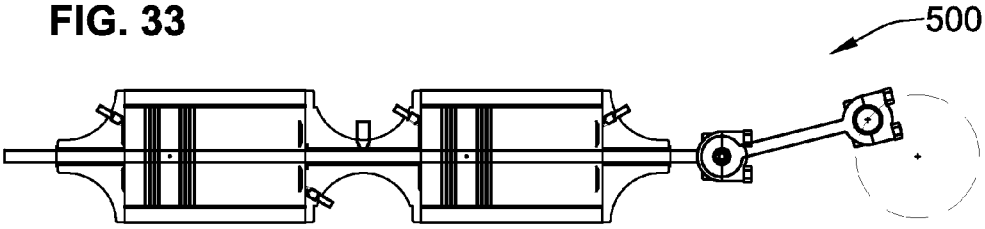
Figure 34:
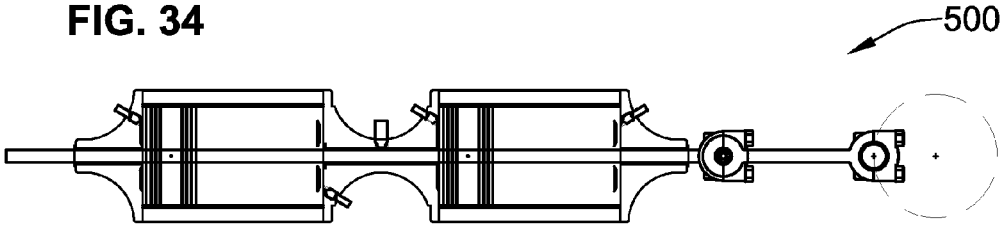

FIG. 25 illustrates a further embodiment of a duel power stroke internal combustion engine 500. This engine 500 is an inline engine but utilizes diesel-over-diesel. FIGS. 26-34 illustrate the combustion cycle for this embodiment. This cycle is substantially similar to the cycle discussed above for compression chamber 122 of the embodiment of FIG. 1.

Figure 35:
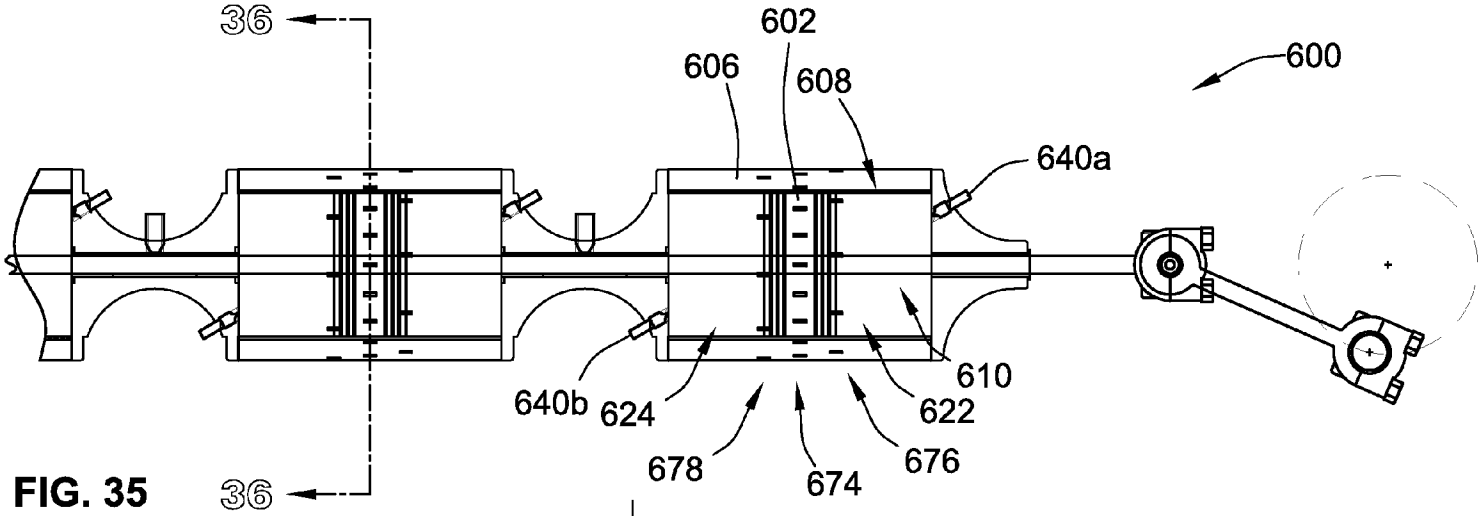
FIGS. 35 and 36 are simplified schematic illustrations of an alternative embodiment of an engine.
Figure 36:
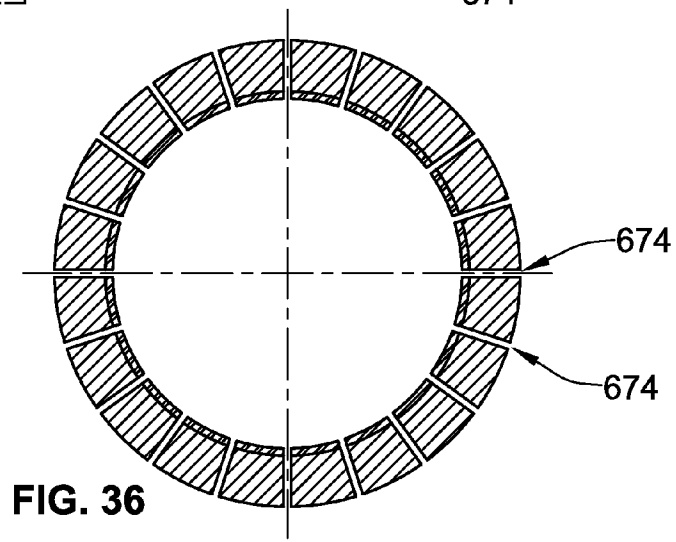

FIGS. 35 and 36 illustrates a further embodiment of a duel power stroke internal combustion engine 600 that is also an inline engine. This embodiment is a diesel-over-diesel engine that uses fixed ports and is similar to the embodiment of FIGS. 13 and 14 except that the gasoline side is replaced with a diesel side.

More particularly, the engine 600 includes double-ended piston 602 that is positioned within cavity 610 formed by cylinder wall 606 and sleeve 608. The piston 602 divides cavity 610 into compression chambers 622, 624. As this is a diesel-over-diesel engine, each side includes a diesel fuel injector 640A, 640B. The cylinder wall 606 and sleeve 608 includes a set of exhaust vanes 674 and first and second sets of intake vanes 676, 678.

Operation of the engine is illustrated in FIGS. 37-45.

Figure 37:
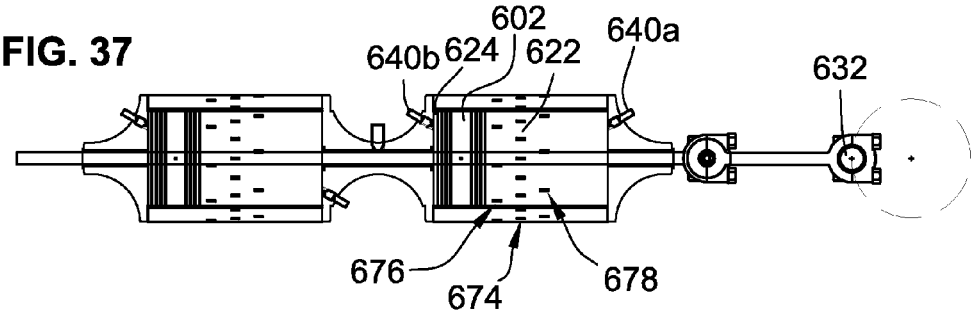
FIGS. 37-45 illustrate the progression of the engine in FIGS. 35-36 during one complete combustion cycle.

In FIG. 37, the piston 602 is at top dead center with regard to compression chamber 624 and at the beginning of the power stroke and beginning to move back toward the right side towards crankshaft 632. The intake vanes 676, 678 are exposed and allowing fresh air into right side compression chamber 622. Exhaust vanes 674 are exposed allowing previously combusted gasses to exit the right side compression chamber 622. Both diesel fuel injectors 640A, 640B are inactive.

Figure 38:
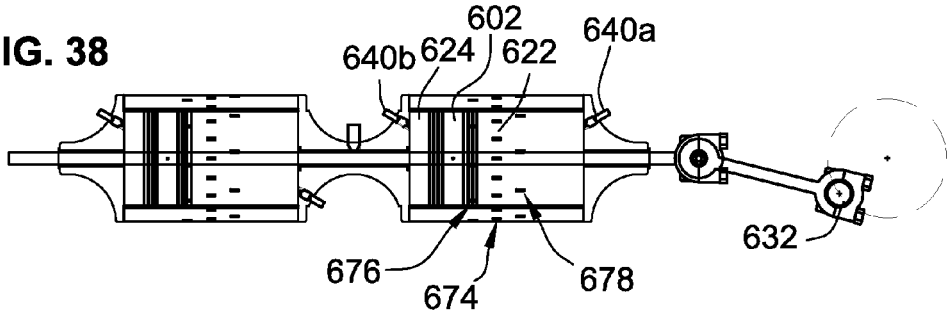

In FIG. 38, the piston 602 is under a pressure stroke due to combustion within left side compression chamber 624. Gases are being exhausted from compression chamber 622 through exhaust vanes 674 and pressurized fresh air enters through intake vanes 676. Piston 602 begins to cover intake vanes 678. Both diesel fuel injectors 640A, 640B are inactive.

Figure 39:
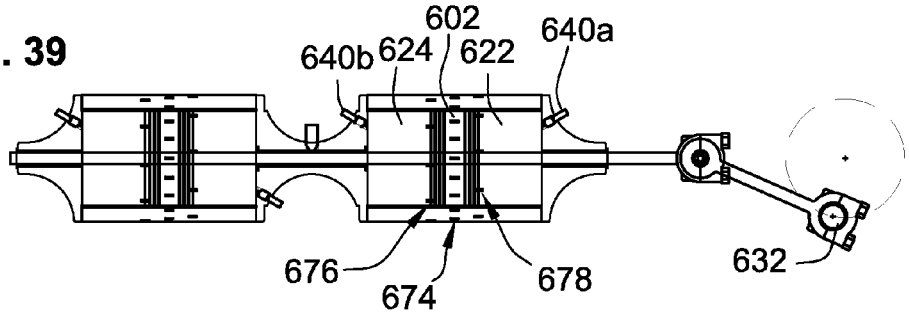

In FIG. 39, the piston 602 is continuing to move toward the right and toward crankshaft 632. The exhaust vanes 674 are closed. The piston begins to cover intake vanes 676 and expose intake vanes 678 such that compression chamber 624 begins to take on fresh air. Fresh air continues to enter through vanes 676 and compression chamber 622 begins to compress. Left side diesel fuel injector 640B inactive. Right side diesel fuel injector 640A soon to be in optimum position for injection.

Figure 40:
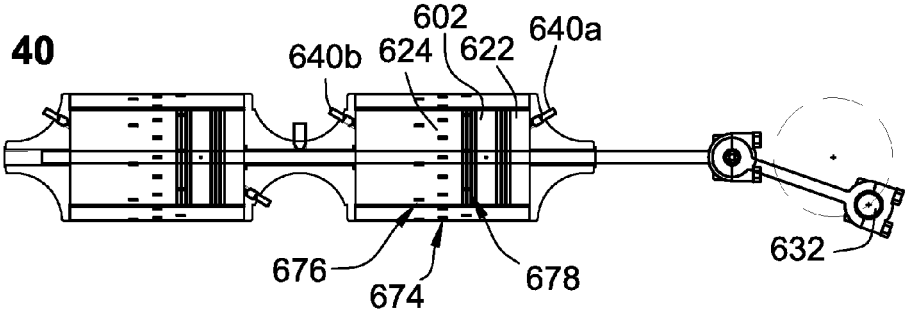

In FIG. 40, the piston 602 is moving to the right and compression chamber 622 is increasing in pressure and starts to be high compression. The intake vanes 678 and exhaust vanes 674 are exposed such that pressurized fresh air is entering compression chamber 624 and combustion gases are exiting the compression chamber 624. Left side diesel fuel injector 640B is inactive. The right side diesel fuel injector 640 active at optimum position for fuel injection.

Figure 41:
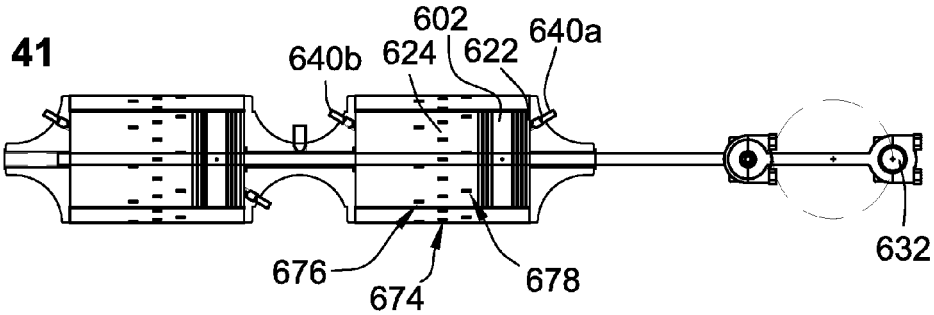

In FIG. 41, the piston 602 is at maximum compression for compression chamber 622. Pressurized intake vanes 676, 678 are open allowing fresh pressurized air into compression chamber 624. Exhaust vanes 674 are exposed allowing exhaust gas to exit compression chamber 624. Combustion occurs in right side compression chamber 622 and the piston 602 begins to change directions under a power stroke. Diesel fuel injectors 640A, 640B are inactive.

Figure 42:
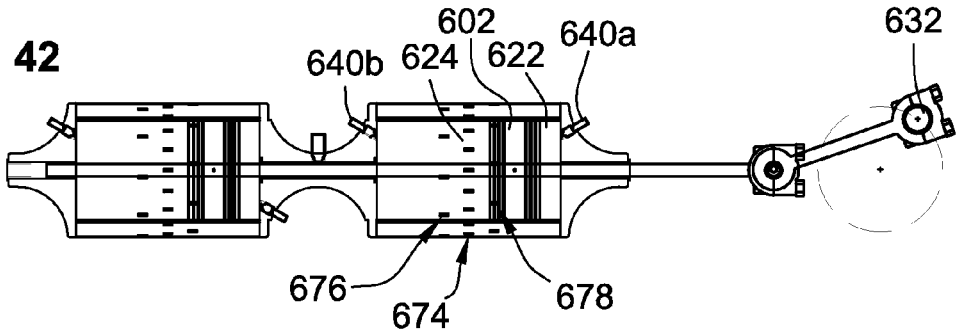

In FIG. 42, the piston 602 is moving toward the left away from crankshaft 632 under the power stroke for compression chamber 622. Piston 602 begins to close intake vanes 676 while vanes 674 and 678 remain open. The diesel fuel injectors 640A, 640B are inactive.

Figure 43:
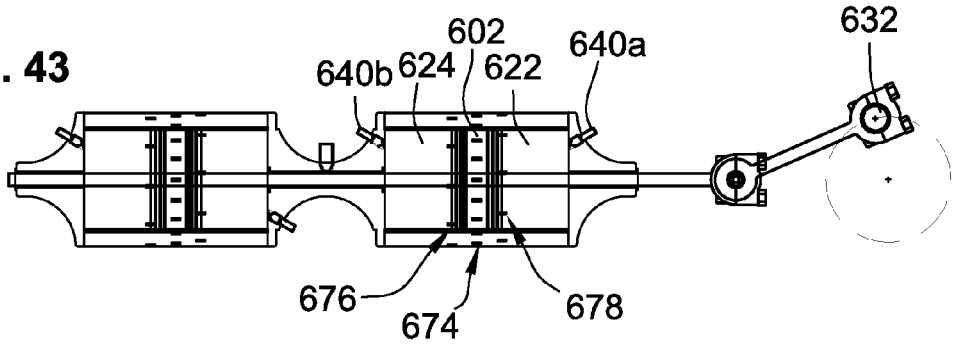

In FIG. 43, the piston 602 closes exhaust vanes 674 and begins to close intake pressurized vanes 678 while beginning to open intake pressurized vanes 676 within compression chamber 622. Diesel fuel injectors 640A, 640B are inactive. Compression chamber 624 begins to compress. The piston 602 is at the midpoint of its stroke length.

Figure 44:
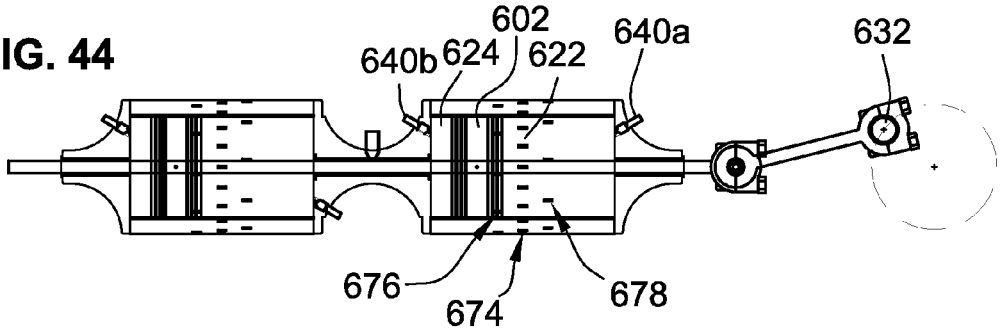

In FIG. 44, the piston 602 is in the middle of the compression stroke for compression chamber 624. The intake vanes 678 are closed. Exhaust vanes 674 and intake vanes 676 are now within compression chamber 622 and open to allow exhaust gases to exit compression chamber 622 and fresh pressurized intake gasses to enter compression chamber 622. Diesel fuel injector 640A is inactive. Diesel fuel injector 640B operates at optimal time for proper fuel-to-air mixture.

Figure 45:
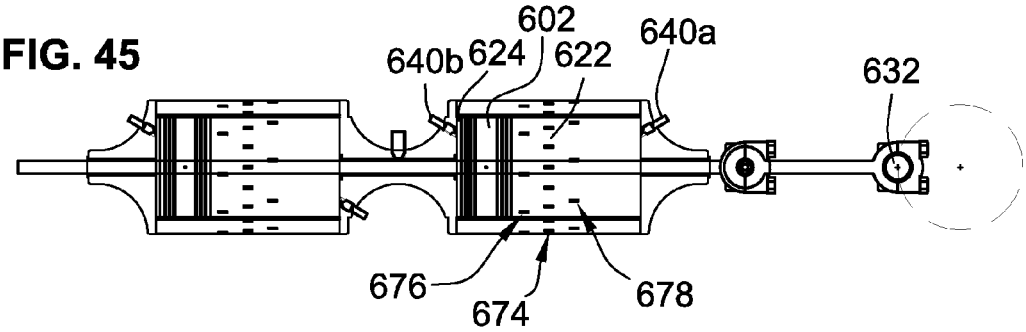

FIG. 45 is identical to FIG. 37 and the cycle repeats beginning with combustion within compression chamber 624 and the piston 602 changing directions and traveling towards crankshaft 632. All vanes 674, 676, 678 are open and in fluid communication with compression chamber 622.

The previously described systems only illustrate a few of the different dual power stroke systems. Further, these systems were described where a power stroke was alternating to drive the piston in both directions. However, in some implementations, only one of the sides of the double-ended pistons will actually receive a power stroke. For instance, in some implementations, (with reference to the embodiment of FIG. 1) only the gasoline powered side of the engine will operate but when more power is necessary the diesel fuel side will either operate simultaneously or by itself with the gasoline side deactivated. Again, this can be provided with different fuels other than gasoline and diesel.

Additionally, in some instances, entire pistons are shut down. For instance, when an inline system is used, at low power demand, less than all of the pistons may be used at one time to reduce fuel consumption and only at high loads will all pistons fire at once. Further, in low power demand situations, a controller can control which pistons fire. Further, the controller could alternate which pistons fire so as to provide more uniform wear on the various pistons of the engines.

Additionally, a controller could be programmed to operate on only those fuels that are within the geographical region where the engine is being used so as to avoid excess fuel prices or accidentally running the engine out of fuel. Such a controller is illustrated in FIG. 1. The controller can be a smart controller configured with wireless communications to get continued updates as to fuel prices and availability to further facilitate decision making as to which type of fuel to use.

The controller could also communicate with load sensors, speed sensor as well as utilize grade data relating to the grade of the terrain on which the vehicle is operating to anticipate engine loads and adjust to the proper fuel usage. By anticipating power needs, fuel consumption can be reduced by avoiding power, and therefore, speed overshoots and undershoots. It requires more fuel to recover from a slowdown of momentum rather than keeping a constant speed. Many GPS systems include grade information that could supply such information to the controller. The controller can also receive data regarding traffic patterns, accidents, the distance to next fueling station, the best fuel prices and the most convenient fueling stations to further determine which fuels to use.

The controller may include a microprocessor for performing the on-the fly data analysis as well as storage media for storing any algorithms or incoming data. Further, the controller may include or be coupled to communications modules, such as cellular or satellite communications modules, to obtain and gather the information. Other communications modules are possible as well such as Bluetooth and wifi.

Figure 46:
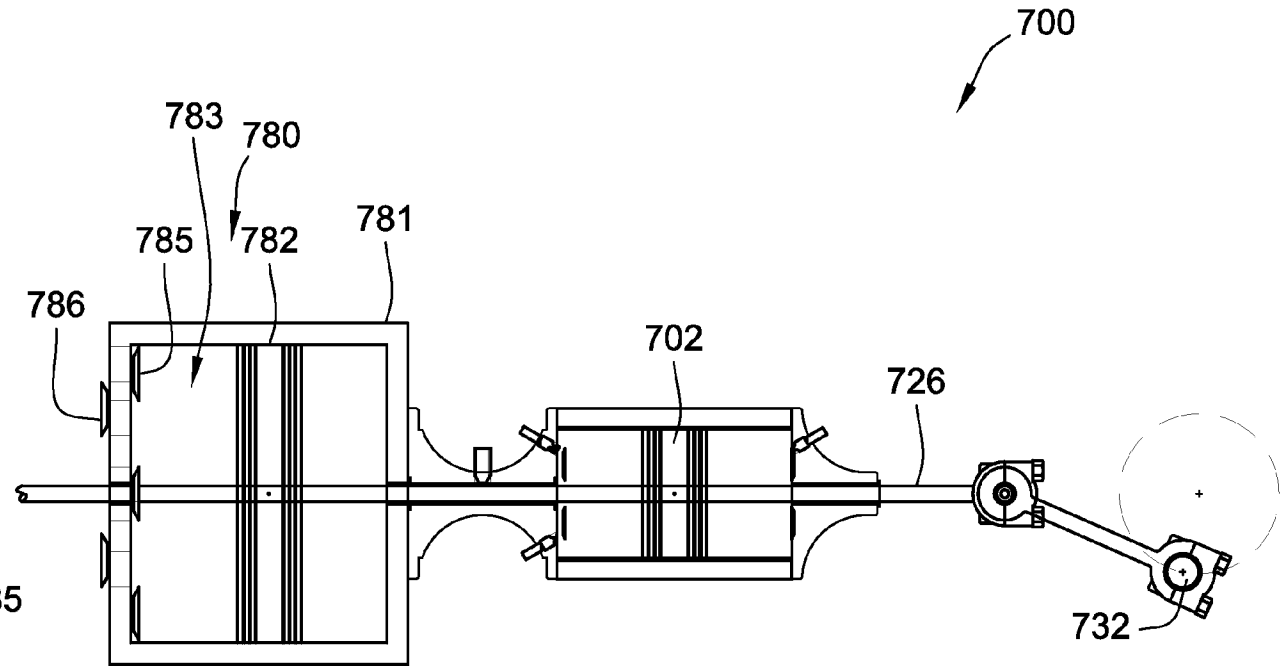
FIGS. 46 and 47 are simplified schematic illustrations of an alternative embodiment of an engine.
Figure 47:
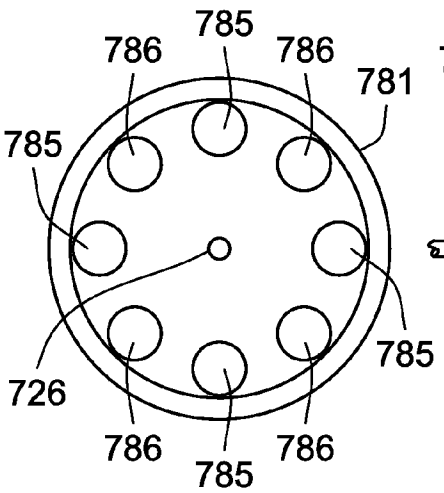

FIGS. 46 and 47 illustrate a further embodiment of an internal combustion engine 700 that uses a dual power stroke. Engine 700 includes a double-ended piston 702 and is configured as a gas-over-diesel engine such as described with reference to FIGS. 1-2. The piston shaft 726 is coupled an air compressing unit 780. The air compressing unit 780 includes an outer cylinder housing 781 and a piston 782 positioned within a cavity 783 defined by outer cylinder housing 781. The cylinder housing 781 includes a plurality of inlet and outlet ports. When the piston 782 is driven toward crankshaft 732, inlet valves 785 open the inlet ports and allow air to be drawn into the cavity 783. When the piston 782 is driven in the opposite direction away from crankshaft 732, the inlet valves 785 close the inlet ports and the outlet valves 786 open and allow the drawn in air to be pumped out of cavity 783. This pressurized air can be ported back to the intake valves or vanes of the engine 700 for combustion purposes, such as through an intake air manifold.

Figures 48, 49:
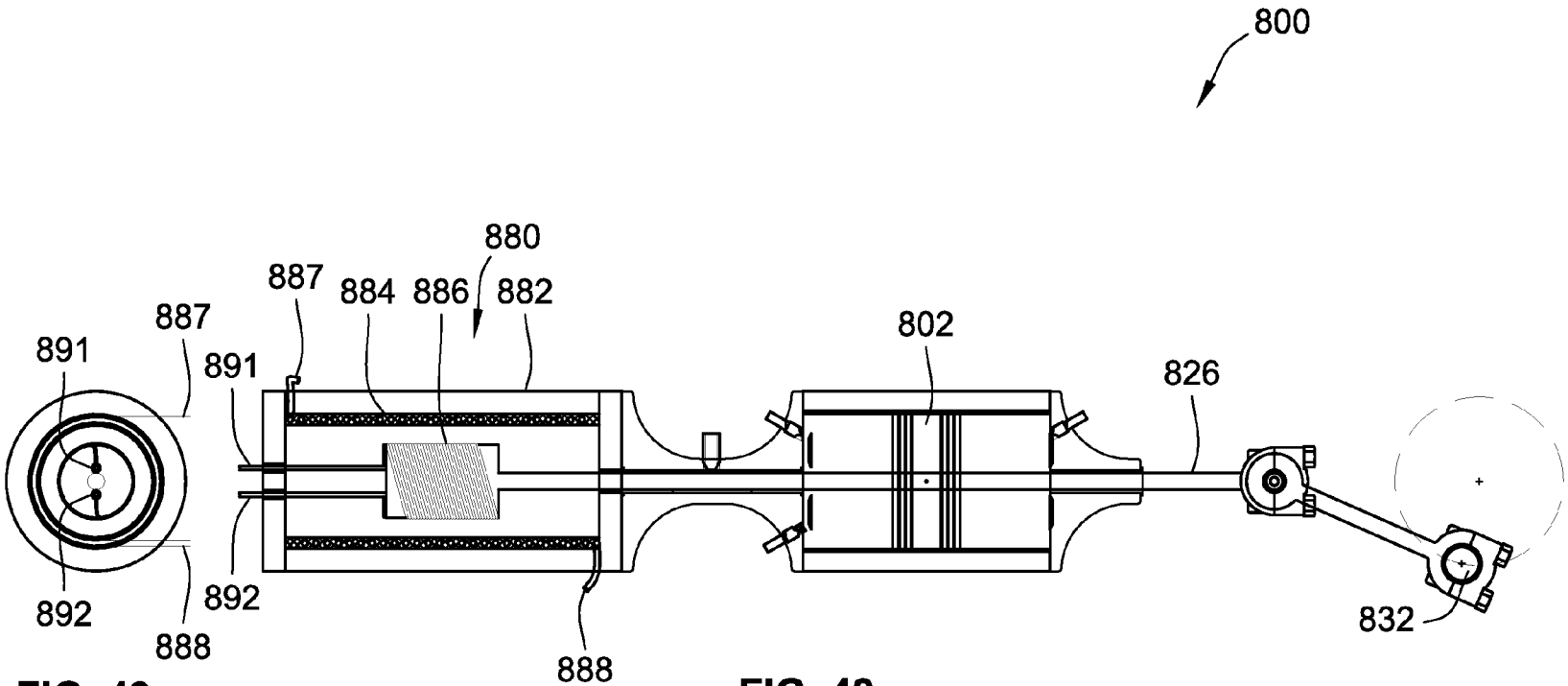
FIGS. 48 and 49 are simplified schematic illustrations of an alternative embodiment of an engine.

FIGS. 48 and 49 illustrate a further embodiment of an engine 800. This system couples the double-ended piston 802 to a generator unit 880 via piston shaft 826. This system is shown with a gas-over-diesel engine. However, other engine systems could be utilized.

The generator unit includes an outer cylinder wall 882, a plurality of output windings 884 a core 886 in the form permanent magnet or wire wound coil within the cylinder wall 882 that is operably coupled to piston shaft 826. Depending on the stroke of direction, the core 886 can cause a current on wires 887, 888 coupled to windings 884. Power is supplied to the wire around core 886 using wires 891, 892. If the power to these wires is switched when the stroke direction switches, wires 887, 888 will output DC current, the supplied power is not reversed, the output from wires 887, 888 will be AC current. Further, with proper design using 3 sets of separate properly offset and wound inline generators, even a 3 phase AC generator would be possible.

Figure 50:
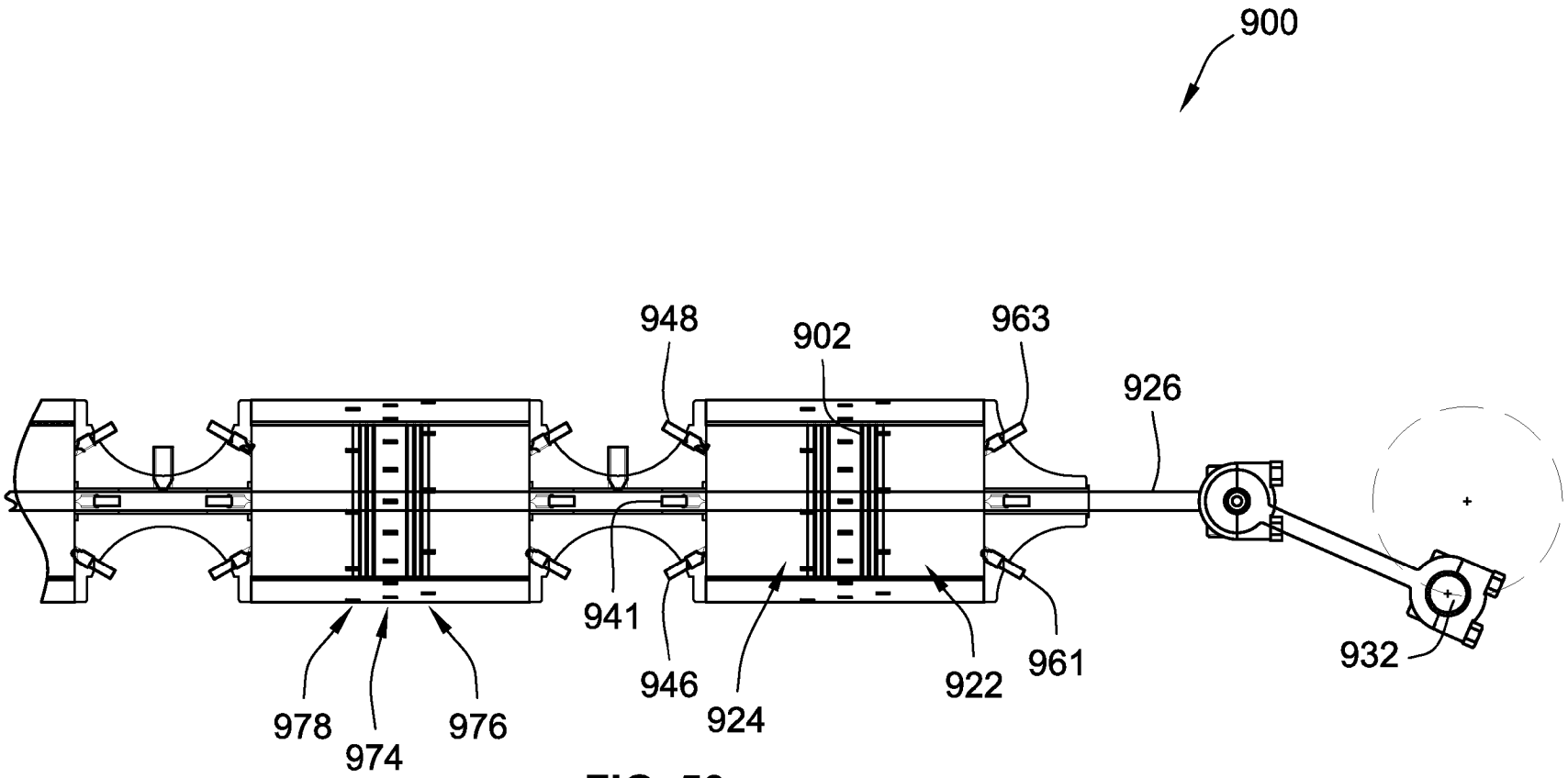
FIG. 50 is a simplified schematic illustration of an alternative embodiment of an engine.

FIG. 50 illustrates an engine 900 that utilizes intake and exhaust vanes 974, 976, 978 similar to discussed above. However, this embodiment includes multiple fuel injectors for one or more of the compression chambers 922, 924. For instance, compression chamber 924 includes spark plug 948 and fuel injector 941 configured for injecting diesel fuel and fuel injector 946 injecting gasoline. Similarly, compression chamber 922 includes a glow plug 961 as well as diesel fuel injector 963 and natural gas, gasoline or LP injector 965. This allows for differing fuels to be injected at optimal times. Further, if appropriate, the different fuels can be mixed.

While shown with fixed ports, alternative designs could include intake and exhaust valves for more precise control of the intake and exhaust ports.

Again, numerous benefits are provided by these various arrangements. First, when different fuels are used on opposite sides of the double-ended pistons, the engine can be used in different regions where only certain fuels are available. For instance, a truck may be configured to run on LNG and use LNG where it is readily available and then run on gasoline or diesel where LNG is not readily available. This could find particular benefits for construction or military equipment which may be used in a large number of geographical regions that have varying fuel supplies.

Second, an engine can be configured to run on a more efficient, cost efficient or emissions friendly fuel when power is not needed and then run solely on a more powerful fuel when at heavy loads. Further, it may be possible to run both the lower power fuel and higher power fuel at the same time so as to maximize total power output.

Further, the inline piston arrangements discussed above could be coupled into a standard V-style or standard-inline configuration. For instance, a V-8 engine design could be coupled with a 3 piston inline design of the current disclosure to convert the engine into a 24 cylinder engine.

While the engines discussed above had a power stroke for each change in direction, the systems could be run such that a power stroke occurs less frequently such that the engine more closely simulates current four-cycle engines.

While the embodiment discussed above in FIGS. 48 and 49 were used to provide pressurized fuel back to the engine itself for combustion purposes, the pumping of the system could be used for other things such as pressurizing a hydraulic system, pumping water or other systems.

By controlling the injection of fuel to either side of the double ended piston, either end of the cylinder can do the bulk of the work. In a 4-cycle engine, 6,000 rmp engine has 3000 firings per cylinder per minute. In a 2-cycle engine, a 3000 rpm engine has 3000 firings per cylinder per minute. Using embodiments of the present invention with firings in both directions, a 1500 rpm engine has 3000 firings or power strokes per piston per minute. This means that at equivalent rpm, these engines will produce considerable amount of greater horsepower and torque.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An engine comprising:

a cylinder wall defining a cavity;

a pair of cylinder head portions attached to the cylinder wall and closing opposite ends of the cavity;

a double-ended piston having opposed piston faces that face axially away from one another, the double-ended piston being positioned within the cavity and separating the cavity into separate first and second compression chambers;

a piston shaft extending through at least one of the cylinder head portions and operably connected to the double-ended piston, the piston shaft moving in reciprocating linear motion with the double-ended piston;

a crankshaft;

a connecting rod operably coupling the piston shaft to the crankshaft;

a first fuel injector operably coupled to a first source of fuel positioned to inject the first fuel into the first compression chamber;

a second fuel injector operably coupled to a second source of fuel, different than the first source of fuel, positioned to inject the second fuel into the second compression chamber;

a controller configured to control operation in a dual power stroke mode where combustion occurs in both the first and second compression chambers; and wherein the controller is also configured to control operation in a single power stroke mode where combustion occurs in only either the first or second compression chamber, the controller configured to switch between the dual power stroke mode and the single power stroke mode.

2. The engine of claim 1, wherein the controller is also configured to switch between the dual power stroke mode and the single power stroke mode depending on the loading on the engine.

3. An engine comprising:

a cylinder wall defining a cavity;

a pair of cylinder head portions attached to the cylinder wall and closing opposite ends of the cavity;

a double-ended piston haying opposed piston faces that face axially away from one another, the double-ended piston being positioned within the cavity and separating the cavity into separate first and second compression chambers;

a piston shaft extending through at least one of the cylinder head portions and operably connected to the double-ended piston shaft moving in reciprocating linear motion with the double-ended piston;

a crankshaft;

a connecting rod operably coupling the piston shaft to the crankshaft;

a first fuel injector operably coupled to a first source of fuel positioned to inject the first fuel into the first compression chamber;

a second fuel injector operably coupled to a second source of fuel, different than the first source of fuel, positioned to inject the second fuel into the second compression chamber; and a controller configured to control operation in a single power stroke mode where combustion occurs in only either the first or second compression chamber.

4. The engine of claim 3, further comprising:

a second cylinder wall defining a second cavity;

a second pair of cylinder head portions attached to the second cylinder wall and closing opposite ends of the second cavity;

a second double-ended piston having opposed piston faces that face axially away from one another, the second double-ended piston being positioned within the second cavity and separating the second cavity into separate third and fourth compression chambers, the second double-ended piston operable connected to the piston shaft such that the piston shaft, first double-ended piston, and second double-ended piston move in coordinated reciprocating linear motion;

a third fuel injector operably coupled to the first source of fuel positioned to inject the first fuel into the third compression chamber; and a fourth fuel injector operably coupled to the second source of fuel positioned to inject the second fuel into the fourth compression chamber.

5. The engine of claim 3, further comprising a controlled device that operates on linear reciprocating motion connected to the piston shaft on an opposite axial side of the double-ended piston as the connecting rod.

6. The engine of claim 5, wherein the controlled device is a fluid pump.

7. The engine of claim 6, wherein the fluid pump is an air pump and an outlet of the air pump is fluidly coupled to an intake port of at least one of the first and second combustion chambers.

8. The engine of claim 5, wherein the controlled device is an electric generator.

9. An engine comprising:

a cylinder wall defining a cavity;

a pair of cylinder head portions attached to the cylinder wall and closing opposite ends of the cavity;

a double-ended piston having opposed faces that face axially away from one another, the double-ended piston being positioned within the cavity and separating the cavity into separate first and second compression chambers;

a piston shaft extending through at least one of the cylinder head portions and operably connected to the double-ended piston, the piston shaft moving in reciprocating linear motion with the double-ended piston;

a crankshaft;

a connecting rod operably coupling the piston shaft to the crankshaft;

a first fuel injector operably coupled to a first source of fuel positioned to inject the fuel into the first compression chamber;

a second fuel injector operably coupled to a second source of fuel, different than the first source of fuel, positioned to inject the second fuel into the second compression chamber; and wherein a compression ratio of the first compression chamber is different than the compression ratio of the second compression chamber.

10. The engine of claim 9, further comprising a controller configured to control operation in a dual power stroke mode where combustion occurs in both the first and second compression chambers.

11. An engine comprising:

a first cylinder wall defining a first cavity;

a first pair of cylinder head portions attached to the first cylinder wall and closing opposite ends of the first cavity;

a first double-ended piston having opposed piston faces that face axially away from one another, the first double-ended piston being positioned within the first cavity and separating the first cavity into separate first and second compression chambers;

a first fuel injector positioned to inject fuel into the first compression chamber;

a second fuel injector positioned to inject fuel into the second compression chamber;

a second cylinder wall defining a second cavity;

a second pair of cylinder head portions attached to the second cylinder wall and closing opposite ends of the second cavity;

a second double-ended piston having opposed piston faces that face axially away from one another, the second double-ended piston being positioned within the second cavity and separating the second cavity into separate third and fourth compression chambers;

a third fuel injector positioned to inject fuel into the third compression chamber;

a fourth fuel injector positioned to inject fuel into the fourth compression chamber;

a piston shaft extending axially through the first pair of cylinder head portions and operably connected to the first double-ended piston, the piston shaft extending through at least one of the second pair of cylinder head portions and operably connected to the second double-ended piston, the piston shaft moving in reciprocating linear motion with the first and second double-ended pistons;

a crankshaft;

a connecting rod operably coupling the piston shaft to the crankshaft;

wherein a compression ratio of the first compression chamber is different than the compression ratio of the second compression chamber.

12. An engine comprising:

a cylinder wall defining a cavity;

a pair of cylinder head portions attached to the cylinder wall and closing opposite ends of the cavity;

a double-ended piston having opposed piston faces that face axially away from one another, the double-ended piston being positioned within the cavity and separating the cavity into separate first and second compression chambers;

a piston shaft extending through at least one of the cylinder head portions and operably connected to the double-ended piston, the piston shaft moving in reciprocating linear motion with the double-ended piston;

a crankshaft;

a connecting rod operably coupling the piston shaft to the crankshaft;

a first fuel injector positioned to inject fuel into the first compression chamber;

a second fuel injector positioned to inject fuel into the second compression chamber; and wherein a compression ratio of the first compression chamber is different than the compression ratio of the second compression chamber.

* * * * *

UNITED STATES PATENT AND TRADEMARK OFFICE

CERTIFICATE OF CORRECTION

PATENT NO. : 9,010,287 B2
APPLICATION NO. : 14/212013
DATED : April 21, 2015
INVENTOR(S) : Steven Morreim It is certified that error appears in the above-identified patent and that said Letters Patent is hereby corrected as shown below:

In the Claims

In column 14, line 56, a --,-- and the words --the piston-- should be inserted and insert the words after "ended piston" to read "ended piston, the piston shaft".

Signed and Sealed this
Third Day of November, 2015

Michelle K. Lee

Michelle K. Lee
*Director of the United States Patent and Trademark Office*